US011003108B2

(12) United States Patent
Sunahara et al.

(10) Patent No.: US 11,003,108 B2
(45) Date of Patent: May 11, 2021

(54) DEVELOPMENT DEVICE, CARTRIDGE, AND IMAGE FORMING APPARATUS

(71) Applicant: CANON KABUSHIKI KAISHA, Tokyo (JP)

(72) Inventors: Satoshi Sunahara, Hachioji (JP); Nobuo Oshima, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/997,353

(22) Filed: Aug. 19, 2020

(65) Prior Publication Data

US 2021/0055672 A1 Feb. 25, 2021

(30) Foreign Application Priority Data

Aug. 23, 2019 (JP) ..... JP2019-153054

(51) Int. Cl.
*G03G 15/00* (2006.01)
*G03G 15/08* (2006.01)

(52) U.S. Cl.
CPC ..... *G03G 15/0872* (2013.01); *G03G 15/0889* (2013.01); *G03G 15/0865* (2013.01)

(58) Field of Classification Search
CPC ..... G03G 15/0822; G03G 15/0839; G03G 15/0865; G03G 15/0867; G03G 15/0872; G03G 15/0889; G03G 21/1676
See application file for complete search history.

(56) References Cited

U.S. PATENT DOCUMENTS

2009/0297178 A1* 12/2009 Kakuta ..... G03G 15/0856 399/27
2011/0103843 A1* 5/2011 Sato ..... G03G 15/0812 399/254

FOREIGN PATENT DOCUMENTS

JP 2005-140908 A 6/2005
JP 2007-322936 A 12/2007
JP 2016-156955 A 9/2016
JP 2018-072601 A 5/2018

* cited by examiner

*Primary Examiner* — Hoang X Ngo
(74) *Attorney, Agent, or Firm* — Canon U.S.A., Inc. IP Division

(57) ABSTRACT

A development frame body includes a concave portion, which is projected in a direction along an upward direction of a gravitational direction, and which is located at a downstream side of a communication port and an upstream side of a replenishing port, the concave portion and the replenishing port overlap with each other in an axis direction of a shaft portion when viewed in a direction orthogonal to the axis direction, a relationship R1≤L is satisfied, when a free length of the sheet portion is L and a distance from a rotation center of the shaft portion to an inner wall face is R1, and slit portions are formed in a free end of the sheet portion so that a section of the free end of the sheet portion can enter the concave portion when an agitation member is rotated.

15 Claims, 28 Drawing Sheets

O-P1: R1 (< L)
O-P2: L

O-P1: R1 (< L)
O-P5: R3 (< R1 < L)

O-P1: R1 (< L)
O-P5: R3 (< R1 < L)

DEVELOPMENT DEVICE, CARTRIDGE, AND IMAGE FORMING APPARATUS

BACKGROUND

Field

The present disclosure relates to an image forming apparatus and a development device and a cartridge used for the image forming apparatus. Particularly, the present disclosure relates to an electrophotographic image forming apparatus employing an electrophotographic method and a development device and a cartridge used for the electrophotographic image forming apparatus.

Description of the Related Art

Conventionally, there have been widely known replaceable constituent elements such as a development cartridge (including a development unit) and a process cartridge (including a development unit and a photosensitive drum), which can be attached to and detached from an apparatus main body of an electrophotographic image forming apparatus.

Further, a toner cartridge capable of replenishing toner to a toner containing unit of the development cartridge, which can be attached (connected) to the development cartridge (or the process cartridge) has been known (see Japanese Patent Application Laid-Open No. 2016-156955).

Specifically, according to a configuration discussed in Japanese Patent Application Laid-Open No. 2016-156955, toner supplied to a toner containing unit from a toner cartridge via a replenishing port is agitated and mixed with toner already existing in the toner container unit by an agitation member arranged in the toner containing unit. The agitation member includes a rotating agitation shaft and a sheet fixed to the agitation shaft at one end, having the other end as a free end. In order to improve the conveyance performance and the agitation performance, the agitation member is arranged so that a free end of the sheet kept in a warped state can rub against the inner wall face of the toner containing unit.

However, in the configuration discussed in Japanese Patent Application Laid-Open No. 2016-156955, when toner is supplied to the development cartridge from the toner cartridge, toner within the toner containing unit may flow back to the toner cartridge via the replenishing port because of elastic deformation of the sheet caused by rotation of the agitation member. This may result in lowering of replenishing efficiency of toner to the development cartridge (or the process cartridge) immediately after replacement of the toner cartridge.

SUMMARY

The present disclosure is directed to a development device, a cartridge, and an image forming apparatus, which can replenish a developer containing chamber with developer, reduce backflow of developer from the developer containing chamber to a replenishing port, and improve replenishing efficiency.

According to an aspect of the present disclosure, a development device includes a development frame body including a development chamber in which a developer bearing body for bearing developer is housed, a developer containing chamber for storing developer to be supplied to the development chamber, and a replenishing port through which the developer containing chamber can be replenished with developer from outside, the developer containing chamber having a communication port for communicating with the development chamber, and an agitation member housed in the developer containing chamber and including a rotatable shaft portion and an elastically-deformable sheet portion, one end of the sheet portion being fixed to the shaft portion as a fixed end, and the other end of the sheet portion being a free end, wherein a developer replenishing device, for replenishing developer to the developer containing chamber via the replenishing port, can be attached to and detached from the development frame body, wherein the development frame body for constructing the developer containing chamber includes a concave portion formed by projecting from an inner wall face of the development frame body, in a direction along an upward direction of a gravitational direction in an in-use orientation, the concave portion being located at a downstream side of the communication port and an upstream side of the replenishing port in a rotation direction of the agitation member, wherein the concave portion and the replenishing port overlap with each other at least at one part in an axis direction of the shaft portion, when viewed in a direction orthogonal to the axis direction of the shaft portion, wherein a relationship $R1 \leq L$ is satisfied when a free length from the fixed end to the free end of the sheet portion is L and a distance from a rotation center of the shaft portion to the inner wall face is R1, and wherein slit portions are formed in the free end of the sheet portion, so that a section of the free end of the sheet portion is able to enter the concave portion when the agitation member is rotated.

According to another aspect of the present disclosure, a development device includes a development frame body including a development chamber in which a developer bearing body for bearing developer is housed, a developer containing chamber for storing developer to be supplied to the development chamber, and a replenishing port through which the developer containing chamber can be replenished with developer from outside, the developer containing chamber having a communication port for communicating with the development chamber, and an agitation member, housed in the developer containing chamber and including a rotatable shaft portion and an elastically-deformable sheet portion, one end of the sheet portion being fixed to the shaft portion as a fixed end, and the other end of the sheet portion being a free end, wherein a developer replenishing device, for replenishing developer to the developer containing chamber via the replenishing port, can be attached to and detached from the development frame body, wherein the development frame body for constructing the developer containing chamber includes a convex portion formed by projecting from an inner wall face of the development frame body, in a direction along a downward direction of a gravitational direction in an in-use orientation, the convex portion being located at a downstream side of the communication port and an upstream side of the replenishing port in a rotation direction of the agitation member, wherein the convex portion and the replenishing port overlap with each other at least at one part in an axis direction of the shaft portion, when viewed in a direction orthogonal to the axis direction of the shaft portion, wherein a relationship $R4 < R1 \leq L$ is satisfied when a free length from the fixed end to the free end of the sheet portion is L, a distance from a rotation center of the shaft portion to the inner wall face is R1, and a distance from the rotation center of the shaft portion to a leading end of the convex portion is R4, and wherein, in the axis direction, a first slit portion is formed in the sheet portion at a position corresponding to one end portion of the replenishing port, and a second slit portion is formed in the sheet portion at a position corresponding to the other end portion of the replenishing port.

Further, a cartridge according to the present disclosure includes the development device, and a developer replenishing device for replenishing developer to the developer containing chamber, which can be attached to and detached from the development frame body.

Furthermore, an image forming apparatus according to the present disclosure includes the development device or the cartridge, and a transfer member.

Further features of the present disclosure will become apparent from the following description of exemplary embodiments with reference to the attached drawings.

DESCRIPTION OF THE EMBODIMENTS

An electrophotographic image forming apparatus according to the present invention (hereinafter, simply called "image forming apparatus") will be described with reference to the appended drawings.

In addition, the below-described exemplary embodiments are merely examples illustratively describing the present disclosure, and a scope of the present disclosure is not intended to be limited to sizes, materials, shapes and a relative positional relationship of the constituent elements described below unless such specific limitations are described in particular.

Herein, the electrophotographic image forming apparatus is an apparatus which forms an image on a recording medium by employing an electrophotographic image forming method. Therefore, electrophotographic copying machines, electrophotographic printers (such as laser beam printers and light-emitting diode (LED) printers), facsimile apparatuses, and word processors are given as the examples of the electrophotographic image forming apparatus.

Further, a development device used for the image forming apparatus is a device including at least a development unit. The development device may be formed into a cartridge that can be attached to or detached from a main body of the electrophotographic image forming apparatus. Further, the development device may also include a toner cartridge for replenishing toner to the development device, which can be attached to and detached from a frame body of the development device.

A process cartridge that constitutes a part of the image forming apparatus is configured of a charging unit, a development unit (or a cleaning unit), and an electrophotographic photosensitive drum, integrated into a form of a cartridge that can be attached to and detached from a main body of the electrophotographic image forming apparatus. Further, a process cartridge is configured of at least any one of a charging unit, a development unit, and a cleaning unit, and an electrophotographic photosensitive drum, integrated into a form of a cartridge that can be attached to and detached from a main body of the electrophotographic image forming apparatus. Furthermore, a process cartridge is configured of at least a development unit and an electrophotographic photosensitive drum, integrated into a form of a cartridge that can be attached to and detached from a main body of the electrophotographic image forming apparatus. In addition, a process cartridge can be a unit fixed to the image forming apparatus.

Hereinafter, an image forming apparatus according to a first exemplary embodiment of the present disclosure will be described with reference to FIGS. 1 to 23.

Figure 2:
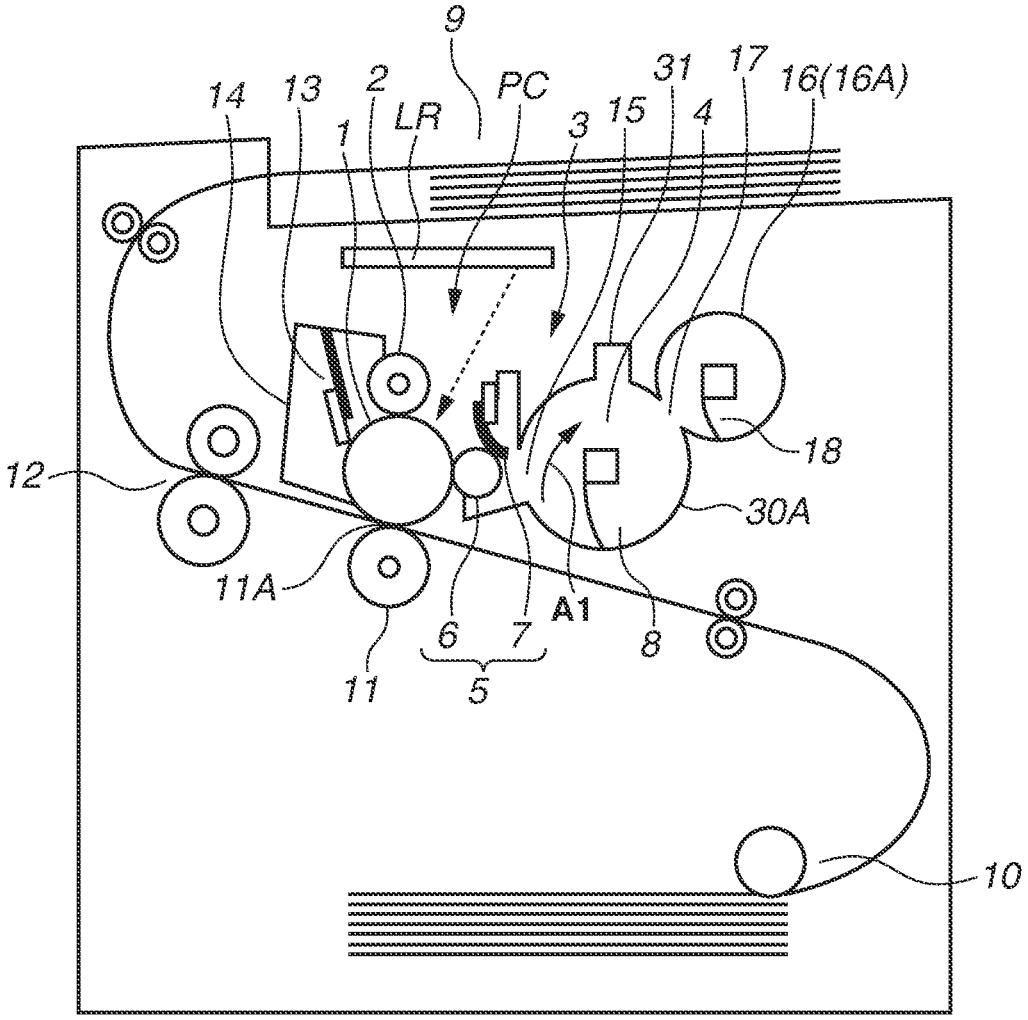
FIG. 2 is a conceptual cross-sectional diagram illustrating the image forming apparatus according to the first exemplary embodiment of the present disclosure.

First, FIG. 2 is a conceptual cross-sectional diagram illustrating the image forming apparatus according to the present exemplary embodiment of the present disclosure.

As illustrated in FIG. 2, a development device used for the image forming apparatus of the present exemplary embodiment mainly includes a development unit (development roller) for developing an electrostatic latent image formed on a surface of a photosensitive drum with toner and a hopper unit for storing toner supplied to the development unit. In the present exemplary embodiment, a part of the hopper unit constitutes a replaceable toner cartridge that can be separated from the hopper unit.

<Image Forming Apparatus>

Hereinafter, an image forming apparatus 100 and image forming operation will be described with reference to FIG. 2.

As illustrated in FIG. 2, the image forming apparatus according to the present disclosure mainly includes constituent elements such as an image bearing body (photosensitive drum 1), a charging unit (charging roller 2), a development device 3, a transfer device (transfer roller 11), and a fixing device (fixing roller 12).

Specifically, the charging roller 2 serving as a charging unit abuts on the photosensitive drum 1 serving as an image bearing body to apply charging bias thereto, so that a surface of the photosensitive drum 1 is charged at a predetermined dark portion potential Vd. In the present exemplary embodiment, direct-current (DC) bias is applied by using a negatively-charged photosensitive body.

Then, a laser emitting device LR serving as an exposure unit exposes the surface of the photosensitive drum 1 with light, so that an electrostatic latent image is formed thereon.

The development device 3 includes a development frame body 30A. Further, the development frame body 30A mainly includes a first hopper unit 4 (developer containing chamber) and a development unit 5 (development chamber). The development frame body 30A further includes a development opening 15 (communication port) and a supply port 17 (replenishing port) described below.

In the development device 3, developer (toner) contained in the substantially cylindrical-shaped first hopper unit 4 is supplied to and borne on the developer bearing body 6, and a developer regulation member 7 regulates the developer to a predetermined layer thickness and charging amount. In addition, the developer bearing body 6 and the developer regulation member 7 constitute the development unit 5 (development chamber).

Then, development bias is applied to the developer bearing body 6, so that the electrostatic latent image formed on the photosensitive drum 1 is developed thereby. The first hopper unit 4 includes an agitation member 8 which conveys toner to the development unit 5 while agitating (mixing) the toner within the first hopper unit 4.

In the present exemplary embodiment, the agitation member 8 is configured of a rotating shaft portion 81 and a sheet-like portion 82 (i.e., sheet portion), fixed to the rotating shaft portion 81 (rotating shaft) at one end in a breadthwise direction (fixed end 821), having the other end as a free end 822.

Further, the developer bearing body 6 is configured of an aluminum base pipe having an elastic layer on a surface thereof and a magnetic roller (not illustrated) disposed inside the aluminum base pipe. An outer surface of the elastic layer of the developer bearing body 6 is in contact with the photosensitive drum 1.

The developer regulation member 7 is configured of a urethane rubber material fixed to a supporting sheet metal, and abuts on the developer bearing body 6. In addition, the toner used for the image forming apparatus according to the present exemplary embodiment is single-component magnetic developer having negative charging polarity.

A transfer member 9 (recording medium) such as a sheet of paper is picked up by a pick-up unit 10 and conveyed to an area (transfer portion 11A) where the transfer roller 11 serving as a transfer unit and the photosensitive drum 1 face one another.

The electrostatic latent image formed on the photosensitive drum 1 is developed with developer supplied from the developer bearing body 6, so that a toner image is formed thereon. The formed toner image is transferred to the transfer member 9 at the transfer portion 11A. The transfer member 9 on which the toner image is transferred passes through the fixing roller 12, so that a fixed image is formed on the transfer member 9.

On the other hand, unused toner is collected from the photosensitive drum 1 by a cleaning member 13 configured of a blade, and stored in a cleaning container 14.

The supply port 17 is arranged on the above-described first hopper unit 4 (developer containing chamber) at a position opposite to the development opening 15 (communication port) connected to the development unit 5 (development chamber). A second hopper unit 16 (developer replenishing device) is connected to the first hopper unit 4 via the supply port 17. Further, the agitation member 8 is arranged inside the first hopper unit 4, and an agitation member 18 is arranged inside the second hopper unit 16.

In the present exemplary embodiment, the second hopper unit 16 (developer replenishing device) is provided as a toner cartridge that can be attached to and detached from the first hopper unit 4 (development frame body 30A). With this configuration, the second hopper unit 16 can be replaced individually.

In addition, the second hopper unit 16 may be one of constituent elements of the development device 3, or may be an element separate from the development device 3. Similarly, the second hopper unit 16 may be one of constituent elements of a process cartridge PC, or may be an element separate therefrom.

For example, in the present exemplary embodiment, the elements excluding the second hopper unit 16, i.e., the first hopper unit 4, the development unit 5, the photosensitive drum 1, the cleaning member 13, and the cleaning container 14, are integrated into the process cartridge PC.

Only the process cartridge PC (or the development device 3) can be replaced when it is necessary to replace a member such as the photosensitive drum 1, the developer bearing body 6, or the developer regulation member 7, having the lifetime longer than that of the toner cartridge.

Figure 3:
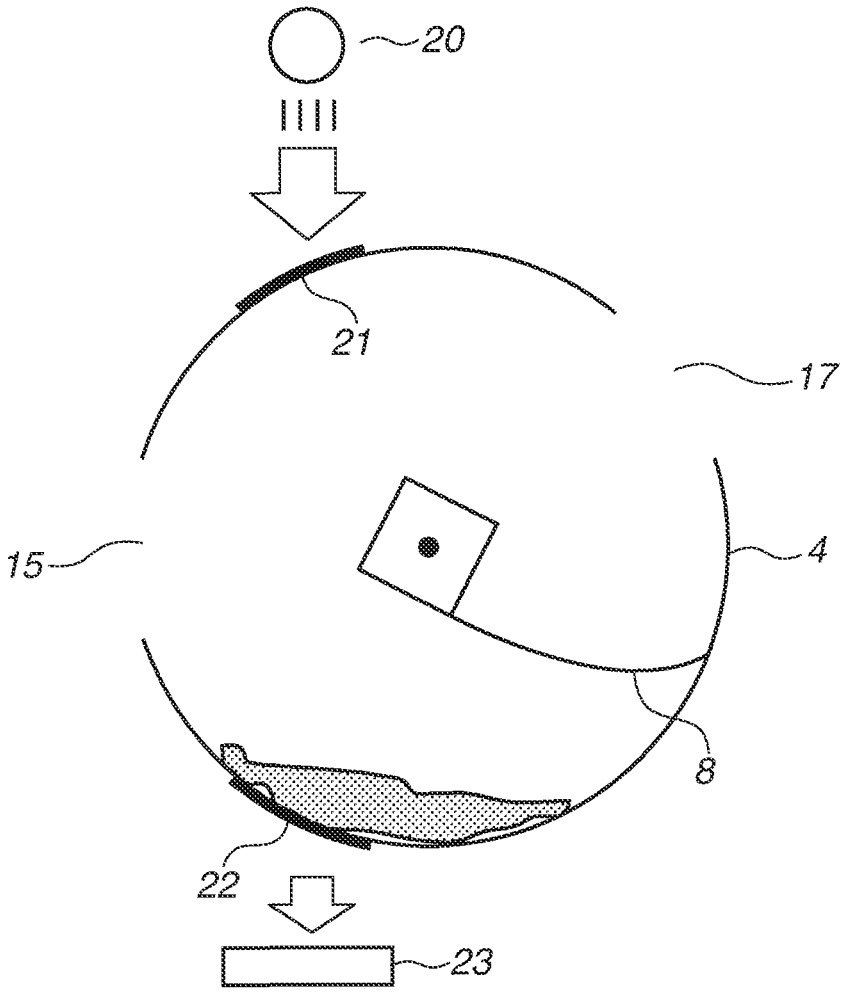
FIG. 3 is a conceptual cross-sectional diagram illustrating a remaining toner amount detection mechanism of a hopper unit of the image forming apparatus according to the first exemplary embodiment of the present disclosure.

FIG. 3 is a conceptual cross-sectional diagram illustrating a remaining toner amount detection mechanism of the first hopper unit 4 of the image forming apparatus according to the present exemplary embodiment of the present disclosure.

As illustrated in FIG. 3, the remaining toner amount detection mechanism is arranged on the first hopper unit 4. Specifically, light 20 is introduced to an end portion of the container through a window portion 21 arranged on the upper side of the first hopper unit 4, and a sensor 23 detects an amount of light passing through a window portion 22 arranged on the lower side thereof to detect a remaining toner amount.

In the present exemplary embodiment, a user is prompted to replace the toner cartridge based on a detection result acquired by the remaining toner amount detection mechanism. With this configuration, it is possible to reduce defective image formation caused by shortage of toner and deterioration of components.

<Configuration of Toner Cartridge>

Next, a toner cartridge 16A configured of the second hopper unit 16 of the present exemplary embodiment will be described in detail with reference to FIGS. 4A and 4B.

Figure 4A:
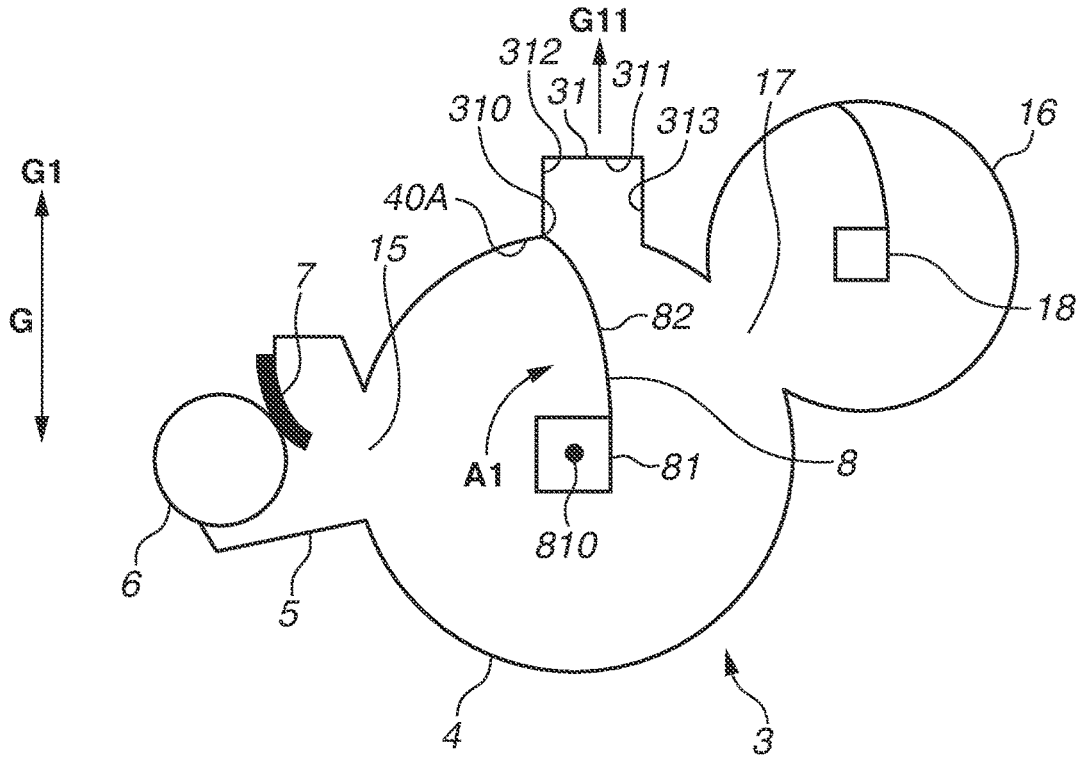
FIG. 4A is a conceptual cross-sectional diagram illustrating a development device used for the image forming apparatus according to the first exemplary embodiment of the present disclosure, to which a toner cartridge is attached.

FIG. 4A is a conceptual cross-sectional diagram illustrating the development device 3 used for the image forming apparatus according to the present exemplary embodiment of the present disclosure, to which a toner cartridge is attached. FIG. 4B is a conceptual perspective diagram illustrating the development device 3 to which the toner cartridge is attached. In addition, in FIG. 4B, the agitation members 8 and 18 are omitted.

Specifically, the agitation member 18 arranged on the toner cartridge 16A is activated, so that toner inside the toner cartridge 16A is supplied to the first hopper unit 4. Further, the first hopper unit 4 and the toner cartridge 16A are connected to each other via the supply port 17.

A width of the supply port 17 in a rotation axis direction A2 of the developer bearing body 6 is expressed as W1.

Further, a width of the developer bearing body 6 in a longitudinal direction of a coating layer 61 coated with toner is expressed as Z.

Figure 4B:
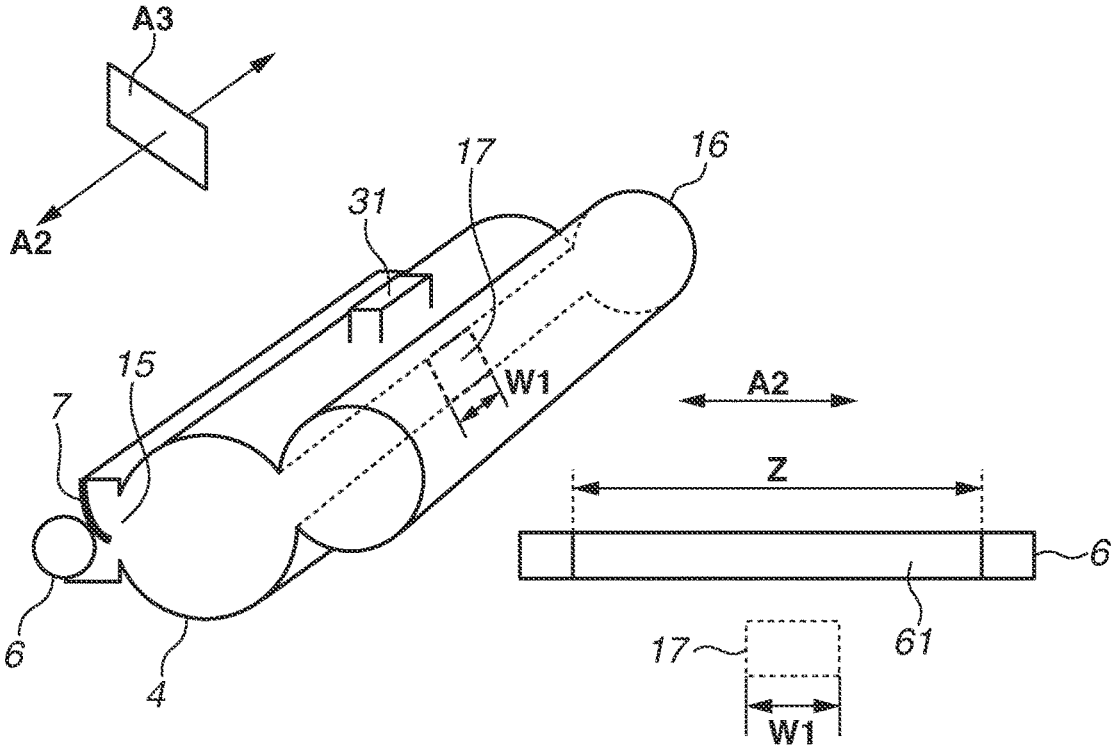
FIG. 4B is a conceptual perspective diagram illustrating the development device to which the toner cartridge is attached.

As illustrated in FIG. 4B, in the present exemplary embodiment, the widths satisfy a relationship "W1<Z", and the supply port 17 is arranged in a vicinity of a central portion (CT) of the developer bearing body 6 in an axis direction of the coating layer 61.

In the present exemplary embodiment, based on a detection result of a remaining amount of toner within the first hopper unit 4 acquired by the remaining toner amount detection mechanism, replenishment of toner (i.e., replacement of the toner cartridge) is notified to the user.

After the user performs replacement work to attach a new toner cartridge, the agitation members 8 and 18 are rotated for approximately 20 seconds (i.e., toner replenishment operation), so that a detection result detected by the remaining toner amount detection mechanism exceeds a predetermined value (remaining toner amount).

<Configuration of Agitation Member>

Next, the agitation member 8 arranged on the first hopper unit 4 will be described. Particularly, a positional relationship between a slit portion arranged on the sheet portion 82 of the agitation member 8 and the supply port 17 will be described.

Figure 5:
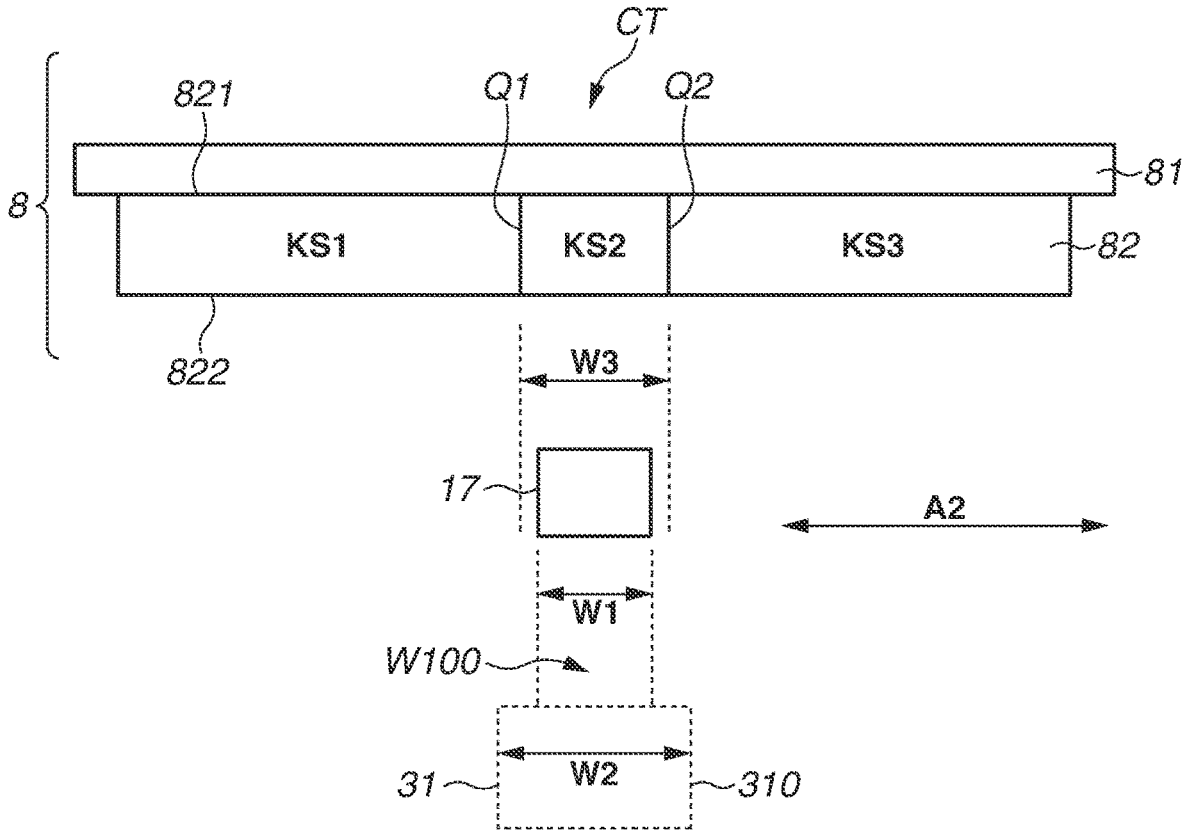
FIG. 5 is a conceptual diagram illustrating a positional relationship among the agitation member, a supply port, and the concave portion of the image forming apparatus according to the first exemplary embodiment of the present disclosure.

FIG. 5 is a conceptual diagram illustrating a positional relationship among the agitation member 8, the supply port 17, and a concave portion 31 of the image forming apparatus according to the present exemplary embodiment of the present disclosure.

As illustrated in FIG. 5, in the present exemplary embodiment, a first cut (slit portion) Q1 and a second cut (slit portion) Q2 are formed on a side of the free end 822 of the flexible sheet portion 82.

In the present exemplary embodiment, a partial area between one end portion and the cut Q1 in the rotation axis direction A2, i.e., a section on a side of one end portion, is called a section KS1 of the sheet portion 82. Further, an area between the cut Q1 and the cut Q2, i.e., a central section, is called a section KS2 of the sheet portion 82. Then, an area between the cut Q2 and the other end portion, i.e., a section on a side of the other end portion, is called a section KS3 of the sheet portion 82.

The section KS2 of the sheet portion 82 is positioned on a central portion CT in the axis direction. Therefore, in comparison to the sections KS1 and KS3, the section KS2 is adjacent to the supply port 17 positioned on the central side. Further, a relationship W3>W1 is satisfied when a width of the section KS2 of the sheet portion 82 in the rotation axis direction A2 is W3 and a width of the supply port 17 is W1. Furthermore, the section KS2 of the sheet portion 82 overlaps with the supply port 17 when viewed in a direction A3 orthogonal to the rotation axis direction A2.

<Configuration of Concave Portion>

The concave portion 31 arranged on the first hopper unit 4 will be described.

Figure 6:
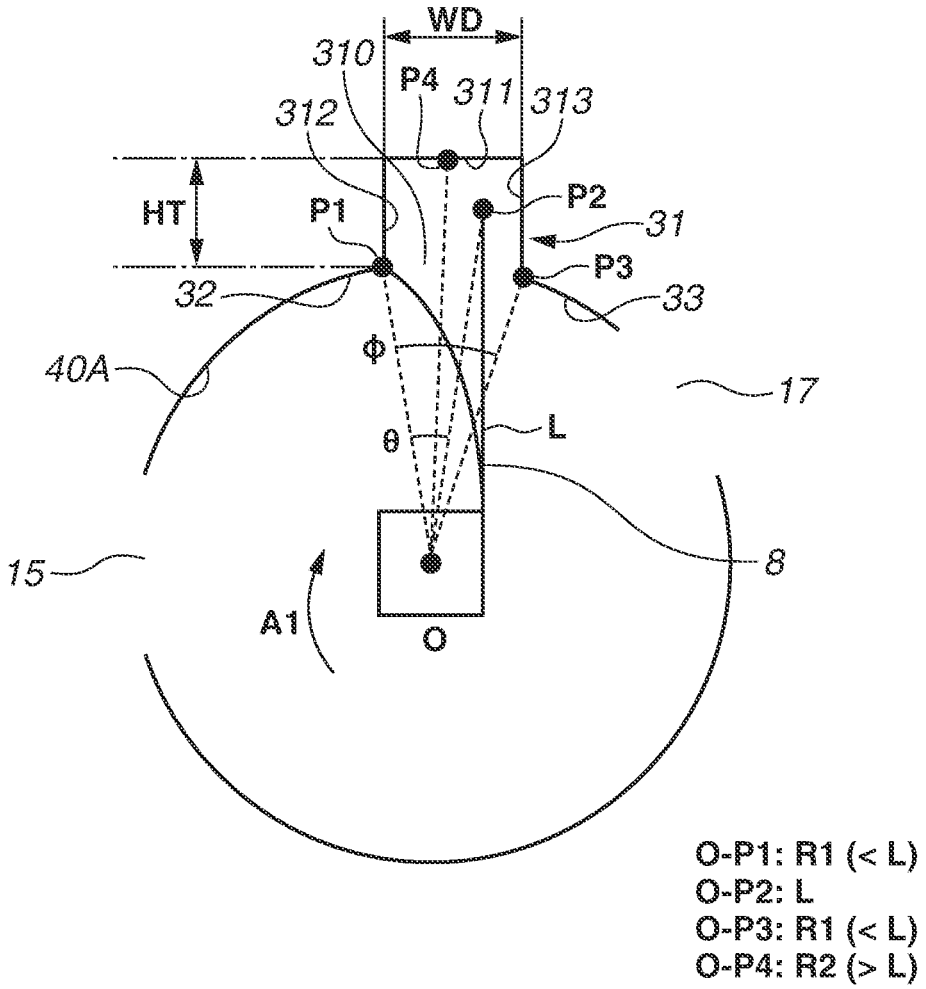
FIG. 6 is a conceptual cross-sectional diagram illustrating shapes of the hopper unit and the concave portion according to the first exemplary embodiment of the present disclosure.

FIG. 6 is a conceptual cross-sectional diagram illustrating shapes of the first hopper unit 4 and the concave portion 31 of the present exemplary embodiment of the present disclosure.

As illustrated in FIG. 6 or 4A, the concave portion 31 projected from the inside to the outside is arranged on the development frame body 30A that forms the first hopper unit 4.

Specifically, the concave portion 31 is formed of an inner wall face 40A of the development frame body 30A, projected in a direction G11 along an upward direction G1 of a gravitational direction G in an in-use orientation, at a position downstream of the development opening 15 and upstream of the supply port 17 in a rotation direction A1 of the agitation member 8.

The concave portion 31 and the supply port 17 overlap with each other at least at one part W100 in the axis direction A2 of the rotating shaft portion 81, when viewed in the direction A3 orthogonal to the axis direction A2 of the rotating shaft portion 81.

Further, a relationship R1≤L is satisfied when a free length from the fixed end 821 to the free end 822 of the sheet portion 82 is L and a distance from the rotation center O of the rotating shaft portion 81 to the inner wall face 40A is R1.

The slit portions Q1 and Q2 are formed on the free end 822 side of the sheet portion 82, so that the section KS2 of the free end 822 of the sheet portion 82 can enter the concave portion 31 when the agitation member 8 is rotated.

As illustrated in FIG. 6, the concave portion 31 includes a bottom face 311, an upstream side face 312 (first side face) positioned upstream of the bottom face 311 in the rotation direction A1 of the agitation member 8, and a downstream side face 313 (second side face) positioned downstream thereof. The bottom face 311 is formed to be orthogonal to the upstream and the downstream side faces 312 and 313.

When the agitation member 8 is driven rotationally, a warped state of the section KS2 of the sheet portion 82 is changed. A position on the upper side of the first hopper unit 4, immediately before the free end 822 of the agitation member 8 reaches the concave portion 31 (i.e., a position upstream of the concave portion 31), is called a position P1. At the position P1, the sheet portion 82 is in a warped state. However, the warp is released when the sheet portion 82 passes the position P1, and the free end 822 thereof moves from the position P1 to a position P2.

In this state, the sheet portion 82 has entered the inside of the concave portion 31. When the agitation member 8 is further rotated and the free end 822 of the sheet portion 82 passes a position P3 immediately after the free end 822 of the sheet portion 82 has come out from the concave portion 31 (i.e., a position downstream of the concave portion 31), the sheet portion 82 is brought into a warped state again. Then, the sheet portion 82 reaches the supply port 17 in that state.

Figure 7:
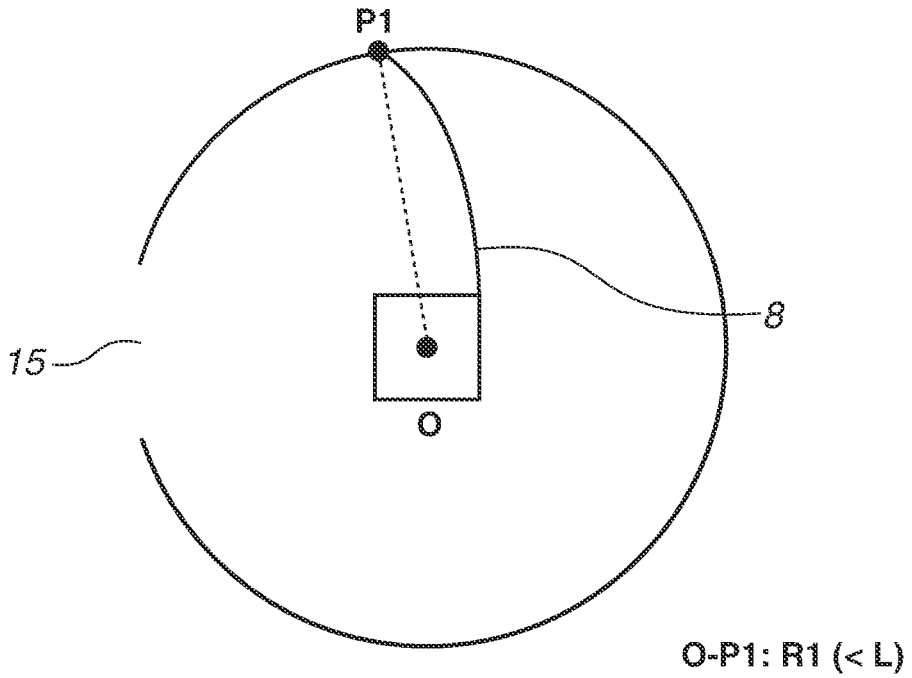
FIG. 7 is a conceptual cross-sectional diagram illustrating a hopper unit according to a reference example of the first exemplary embodiment of the present disclosure.

On the other hand, FIG. 7 is a conceptual cross-sectional diagram illustrating the first hopper unit 4 of a reference example of the present exemplary embodiment of the present disclosure.

As illustrated in FIG. 7, the free end of the sheet portion 82 is kept warped until the sections KS1 and KS3 of the sheet portion 82 reaches the supply port 17 from the development opening 15.

As illustrated in FIG. 6, a relationship L>R1 is satisfied when a distance from the rotation center O of the agitation member 8 to the position P1 is R1 and a rotation radius (i.e., free length) when the sheet portion 82 is rotated in a non-warped (free) state is L.

In the present exemplary embodiment, in the area between the development opening 15 and the position P1 and in the area between the position P3 and the supply port 17, the distance R1 from the rotation center O to the inner wall face 40A is set to be constant. In the present exemplary embodiment, the free length L (rotation radius) is defined by a distance from the rotation center O to the position P2 where the agitation member 8 has a free length L. However, the free length L may be defined as a distance from the fixed end to the free end. In other words, a position of the fixed end can be taken as the rotation center O.

Further, a distance between the top face (bottom face 311) of the concave portion 31 and the rotation center O is greater than the free length L.

On the other hand, when a distance from each of an upstream portion 32 and a downstream portion 33 of the inner wall face adjacent to the concave portion 31 on the upper side of the container to the rotation center O is R1, the distance R1 and the rotation radius (free length) L of the agitation member 8 in a non-warped state satisfy a relationship L>R1.

Further, the width W2 of the concave portion 31 in the rotation axis direction A2 is equal to the width W3 of the section KS2 of the sheet portion 82.

Next, an effect of the present exemplary embodiment will be described by making comparisons between the present exemplary embodiment and comparative examples.

Figure 1:
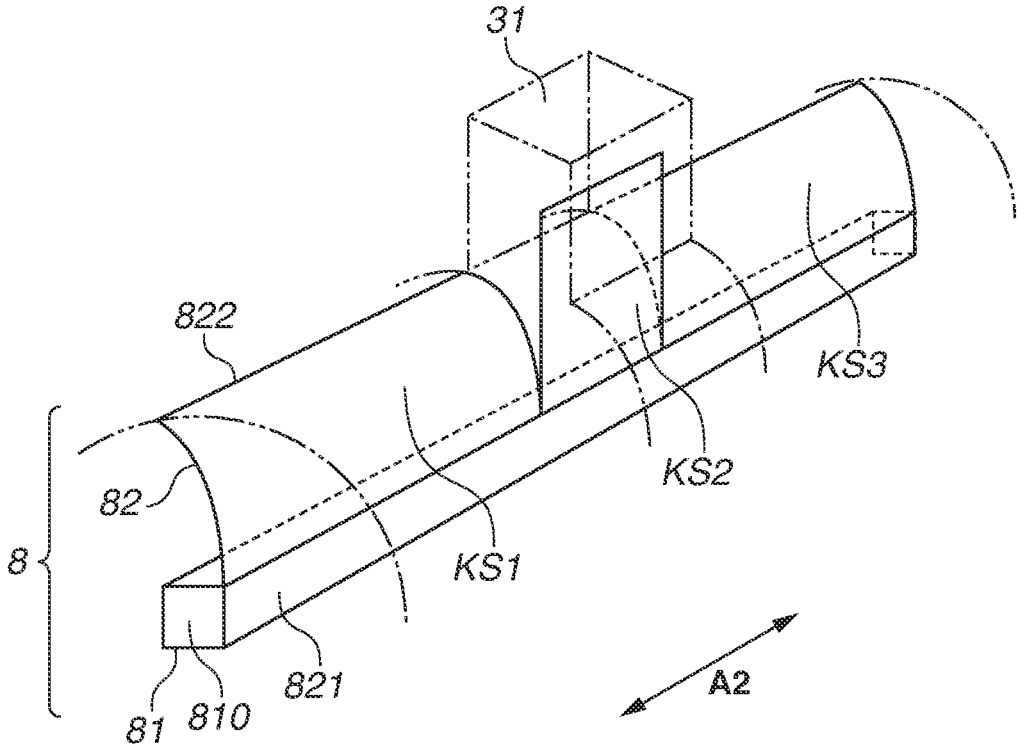
FIG. 1 is a conceptual perspective diagram illustrating an agitation member and a concave portion of an image forming apparatus according to a first exemplary embodiment of the present disclosure.

FIG. 1 is a conceptual perspective diagram illustrating the agitation member 8 and the concave portion 31 of the image forming apparatus according to the present exemplary embodiment of the present disclosure.

Figure 8:
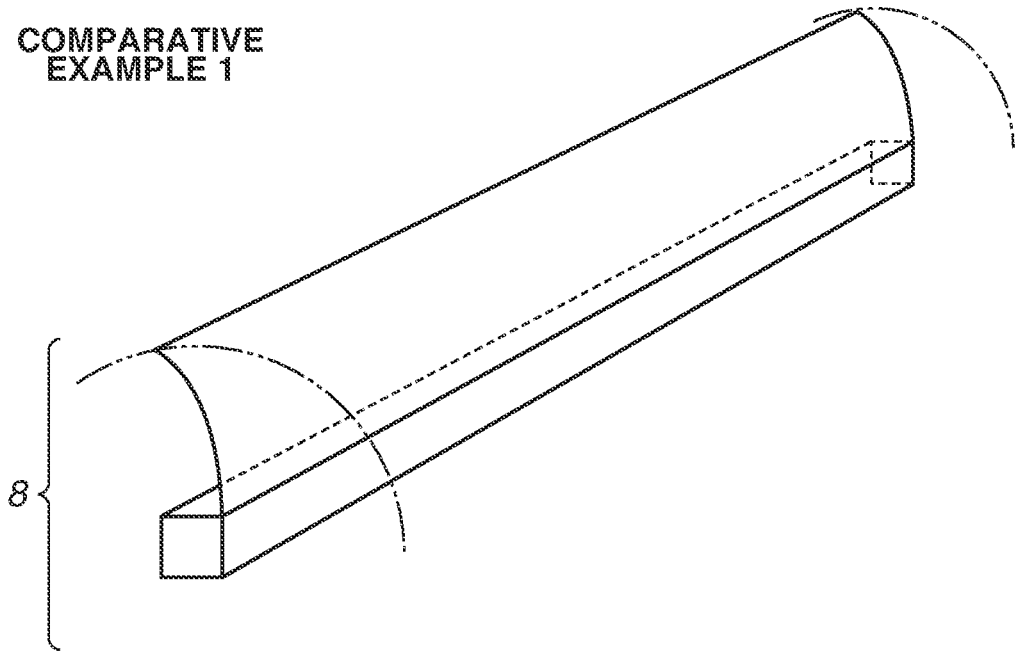
FIG. 8 is a conceptual perspective diagram illustrating an agitation member according to a comparative example 1 of the first exemplary embodiment of the present disclosure.
Figure 9:
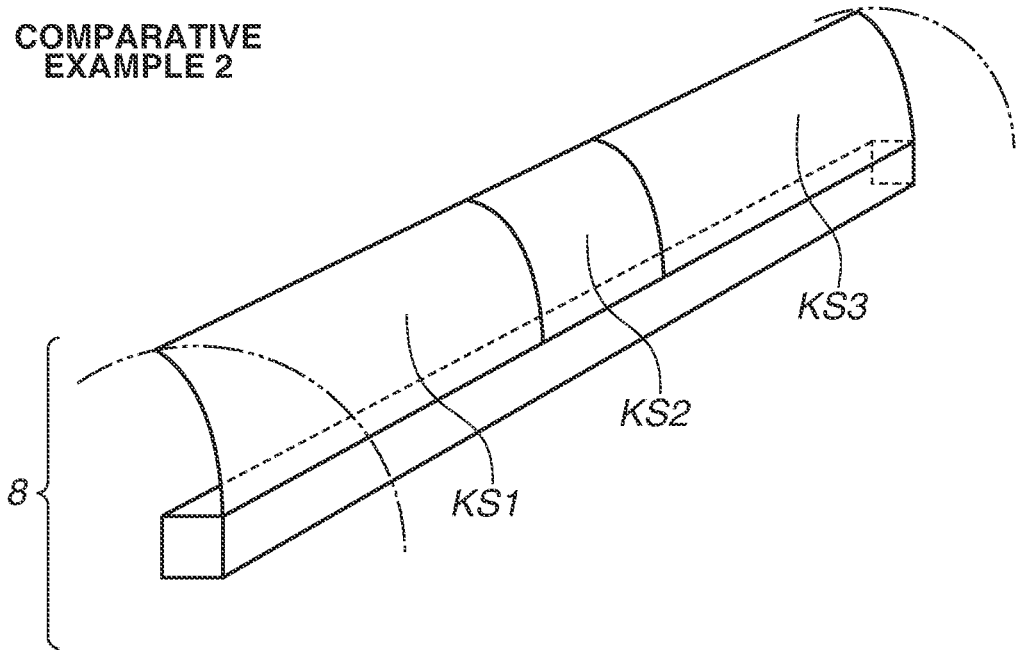
FIG. 9 is a conceptual perspective diagram illustrating an agitation member according to a comparative example 2 of the first exemplary embodiment of the present disclosure.
Figure 10:
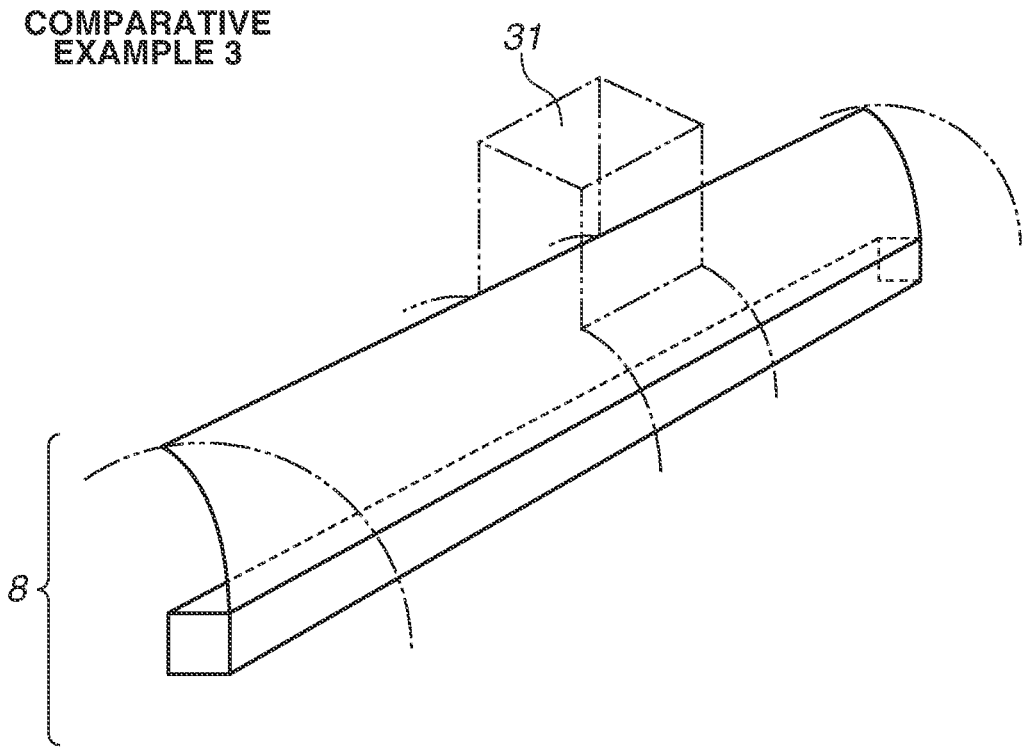
FIG. 10 is a conceptual perspective diagram illustrating an agitation member and a concave portion according to a comparative example 3 of the first exemplary embodiment of the present disclosure.

On the other hand, FIG. 8 is a conceptual perspective diagram illustrating the agitation member 8 of a comparative example 1 of the present exemplary embodiment of the present disclosure. FIG. 9 is a conceptual perspective diagram illustrating the agitation member 8 of a comparative example 2 of the present exemplary embodiment of the present disclosure. Further, FIG. 10 is a conceptual perspective diagram illustrating the agitation member 8 and the concave portion 31 of a comparative example 3 of the present exemplary embodiment of the present disclosure.

Specifically, a configuration of the comparative example 1 is different from the present exemplary embodiment in that the concave portion 31 is not arranged on the first hopper unit 4, and the cuts (slit portions) are not formed in the sheet portion 82 of the agitation member 8.

In the configuration of the comparative example 2, although the cuts (slit portions) are arranged in the sheet portion 82, the concave portion 31 is not arranged on the first hopper unit 4.

In the configuration of the comparative example 3, although the concave portion 31 is arranged on the first hopper unit 4, the cuts (slit portions) are not formed in the sheet portion 82.

In addition, a shape of the first hopper unit 4 and the width W1 of the supply port 17 in each of the comparative examples 1 to 3 are similar to those described in the present exemplary embodiment except for the concave portion 31. Further, the comparison example 2 is similar to the present exemplary embodiment in terms of the agitation member 8 having the slit portions, and the comparative examples 1 and 3 are similar to each other in terms of the agitation member 8 without having the slit portions. Then, the comparative example 3 is similar to the present exemplary embodiment in terms of the shape of the concave portion 31.

Hereinafter, configurations will be described in detail with reference to the drawings.

A warped state of the sheet portion 82 when the free end 822 of the sheet portion 82 has reached the upper portion of the container according to each of the present exemplary embodiment and the comparative examples 1 to 3 is illustrated in each of FIGS. 1, 8, 9, and 10.

Figures 11A, 11B, 11C:
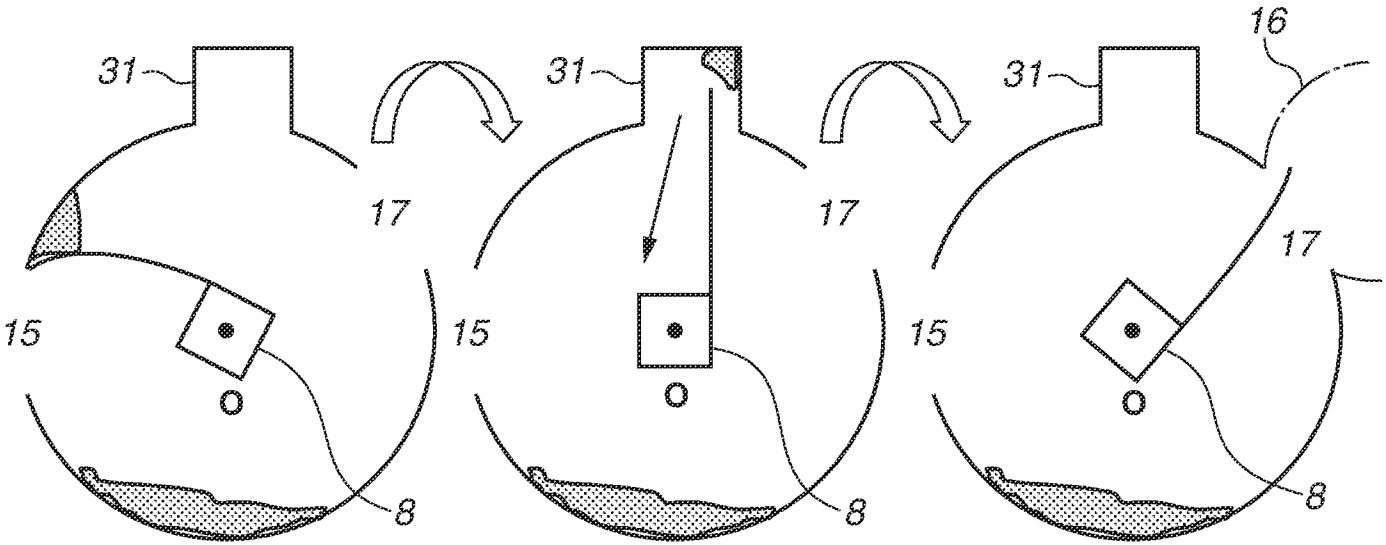
FIGS. 11A to 11C are conceptual diagrams illustrating a relationship between the movement of the agitation member and the movement of toner according to the first exemplary embodiment of the present disclosure.

On the other hand, FIGS. 11A to 11C illustrate a relationship between the movement of the agitation member 8 and the movement of toner in the present exemplary embodiment of the present disclosure.

Figures 12A, 12B, 12C:
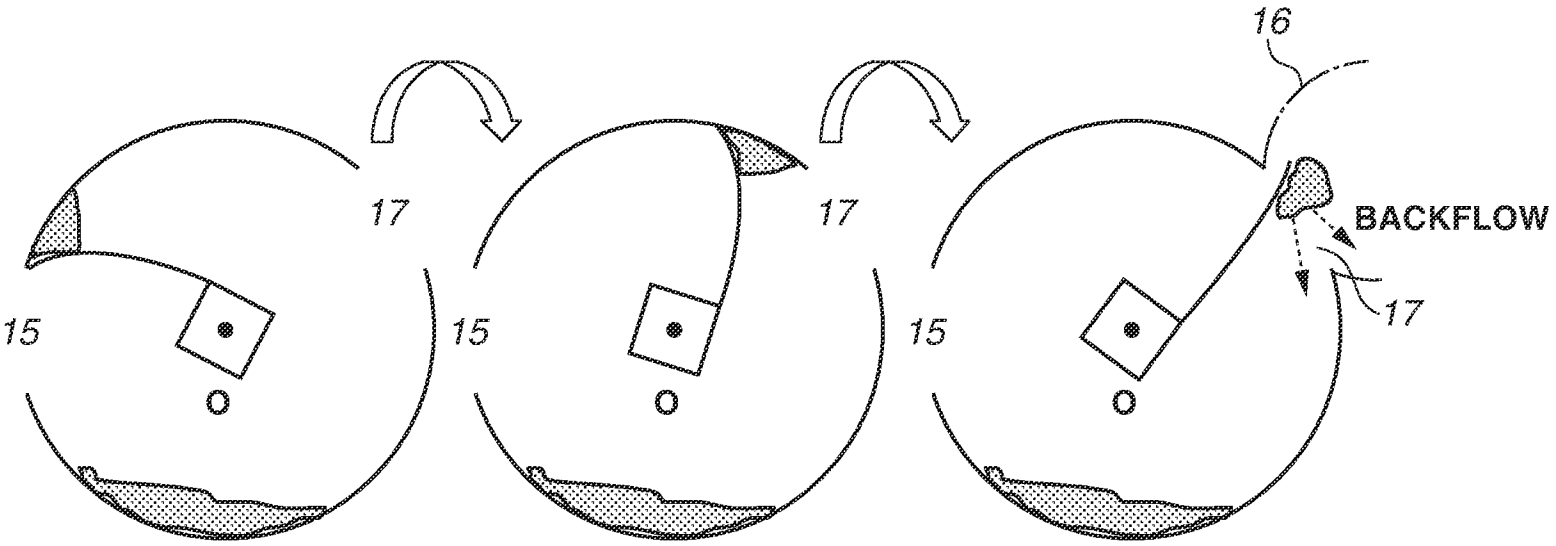
FIGS. 12A to 12C are conceptual diagrams illustrating a relationship between the movement of the agitation member and the movement of toner according to the comparative examples 1 and 2.

FIGS. 12A to 12C illustrate a relationship between the movement of the agitation member 8 and the movement of the toner in the comparative examples 1 and 2.

Figures 13A, 13B, 13C:
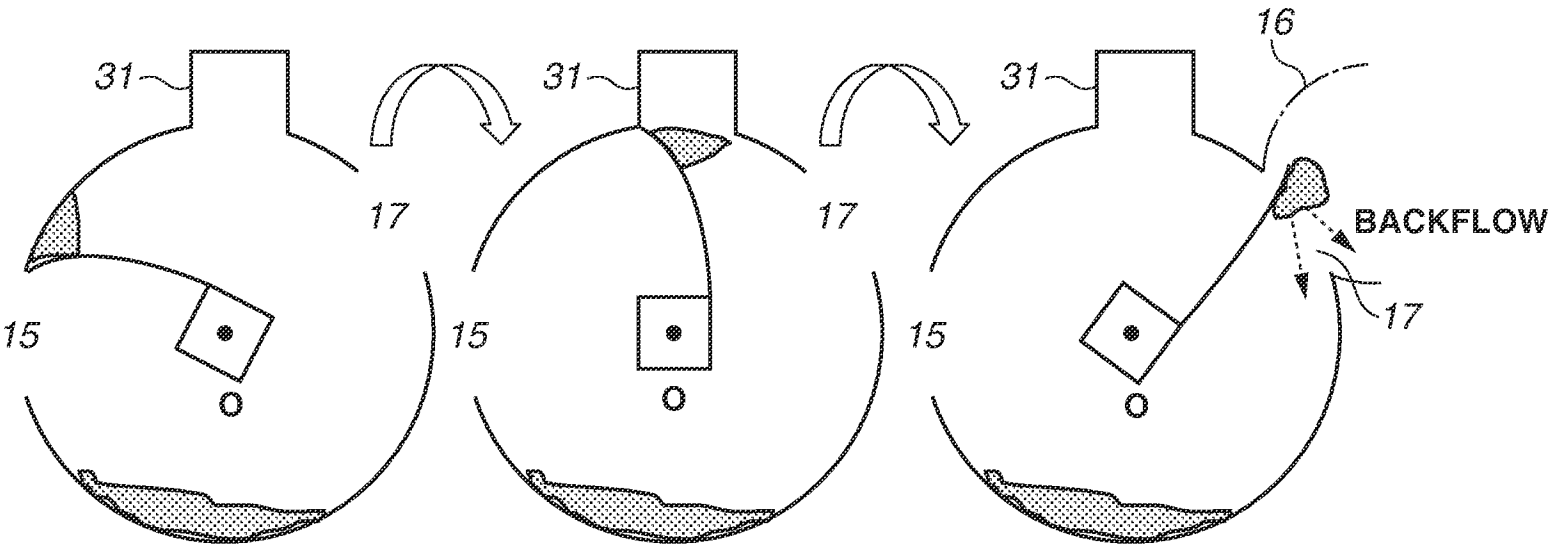
FIGS. 13A to 13C are conceptual diagrams illustrating a relationship between the movement of the agitation member and the movement of toner according to the comparative example 3.

Then, FIGS. 13A to 13C illustrate a relationship between the movement of the agitation member 8 and the movement of toner in the comparative example 3.

When a notification about replacement is output from the remaining toner amount detection mechanism, the developer bearing body 6 (development sleeve) and the developer regulation member 7 (development blade) abut on each other via toner. At this time, a certain amount of toner also remains in the first hopper unit 4.

As illustrated in FIGS. 11A, 12A, and 13A, immediately after the agitation member 8 passes the development opening 15, the sheet portion 82 is in a warped state, and toner is borne by the warped sheet portion 82 and the inner wall face of the first hopper unit 4. At this point, there is no profound difference between the present exemplary embodiment and the respective comparative examples 1 to 3.

However, as illustrated in FIG. 11B, in the present exemplary embodiment, after a leading end of the sheet portion 82 passes the position P1 as a starting point of the concave portion 31, a warp of the section KS2 of the sheet portion 82 is released (reduced). Specifically, a distance R2 between the rotation center O of the agitation member 8 and the position P4 of the bottom face 311 of the concave portion 31 is set to be greater than the rotation radius (free length) L of the non-warped sheet portion 82. Therefore, the warp of the sheet portion 82 is released (reduced) before the sheet portion 82 reaches the supply port 17, so that toner borne by the sheet portion 82 collides against the bottom face 311 and the downstream side face 313 of the concave portion 31, and eventually falls onto an area inside the first hopper unit 4.

When the sheet portion 82 passes the concave portion 31, the sheet portion 82 is brought into a warped state again. Then, as illustrated inn FIG. 11C, when the sheet portion 82 reaches the supply port 17 in that state, a warp thereof is released again. Because the toner on the sheet portion 82 has already fallen when the sheet portion 82 enters the concave portion 31, an amount of toner moving toward the supply port 17 (toner cartridge 16A) is small. In other words, with the configuration of the concave portion 31 according to the present disclosure, an amount of toner returning (flowing back) to the toner cartridge 16A from the supply port 17 is reduced.

On the other hand, in the comparative example 1 illustrated in FIGS. 8 and 12A to 12C, the concave portion 31 is not arranged on the first hopper unit 4. Therefore, as illustrated in FIG. 12B, the sheet portion 82 comes close to the supply port 17 in a state where the sheet portion 82 is brought into the warped state (i.e., in a state where toner is borne thereon). Then, as illustrated in FIG. 12C, when the sheet portion 82 has reached a vicinity area of the supply port 17, a warp thereof is released so that toner is conveyed toward the supply port 17. Therefore, toner is likely to return (or flow back) to the supply port 17 or the toner cartridge 16A. Accordingly, supply of toner from the toner cartridge 16A is interrupted thereby, so that replenishing efficiency will be lowered.

It is conceivable that occurrence of "backflow" can be reduced if the supply port 17 is arranged far from the moving range of the agitation member 8. However, collision of toner supplied from the toner cartridge 16A against toner returned by the agitation member 8 may still occur, so that an influence thereof still remains in the replenishing efficiency.

Further, in the comparative example 2 illustrated in FIGS. 9 and 12A to 12C, although cuts are formed in the sheet portion 82, the container with which the respective sections KS1 to KS3 of the sheet portion 82 divided by the cuts are in contact has a uniform shape. Therefore, the agitation member 8 is rotationally operated in a similar way as the comparative example 1.

Then, in the comparative example 3 illustrated in FIGS. 10 and 13A to 13C, although the concave portion 31 is arranged on the first hopper unit 4, the sheet portion 82 is not divided. Therefore, even if the sheet portion 82 passes the area of the concave portion 31, a warp of the sheet portion 82 is not released, so that a leading end thereof does not enter the concave portion 31. Therefore, when the sheet portion 82 passes the concave portion 31, toner borne on the central portion thereof is conveyed to a vicinity area of the supply port 17 without falling off. As a result, operation thereof is approximately similar to that of the comparative examples 1 and 2.

In addition, a configuration of the present exemplary embodiment (comparative example) was evaluated through the following steps 1 to 10.

1. Prepare a process cartridge having a hopper unit and a replaceable toner cartridge that can be attached to and detached from the process cartridge.
2. Execute printing operation, and stop the printing operation when the remaining toner amount detection unit outputs information about replacement of the toner cartridge.
3. Print a solid image (an image of a printing rate of 100%) in the stopped state, and take the printed solid image as a solid image before replacement of a toner cartridge.
4. Measure a weight of the process cartridge in the stopped state. Then, from a difference between the measured weight and a previously-measured weight of an unused (empty) process cartridge, acquire a remaining amount of toner in the process cartridge (mainly the first hopper unit) before replenishment.
5. Measure a weight of a new toner cartridge (a second hopper unit).
6. Replace the toner cartridge with new one, print one solid image immediately after replacement, take out the process cartridge and the toner cartridge, and measure the weights.
7. Attach the process cartridge and the toner cartridge, and print four solid images.
8. Measure the weights of the process cartridge and the toner cartridge after printing five solid images in total.

9. Attach the respective cartridges again, and further print five solid images.

10. Measure the weights of the process cartridge and the toner cartridge after printing ten solid images in total.

With respect to the ten solid images printed immediately before and after replacement, image density was measured by using a spectrodensitometer model 504 from X-Rite Inc.

Next, experiments was conducted by changing a rotation period (the number of fed sheets) after attaching the toner cartridge.

First, a rotation period after attachment of the toner cartridge is set to 20 seconds, and the influence caused by different shapes of the first hopper unit 4 and the sheet portion 82 in each of the first exemplary embodiment and the comparative examples 1 to 3 was checked.

Figure 14:
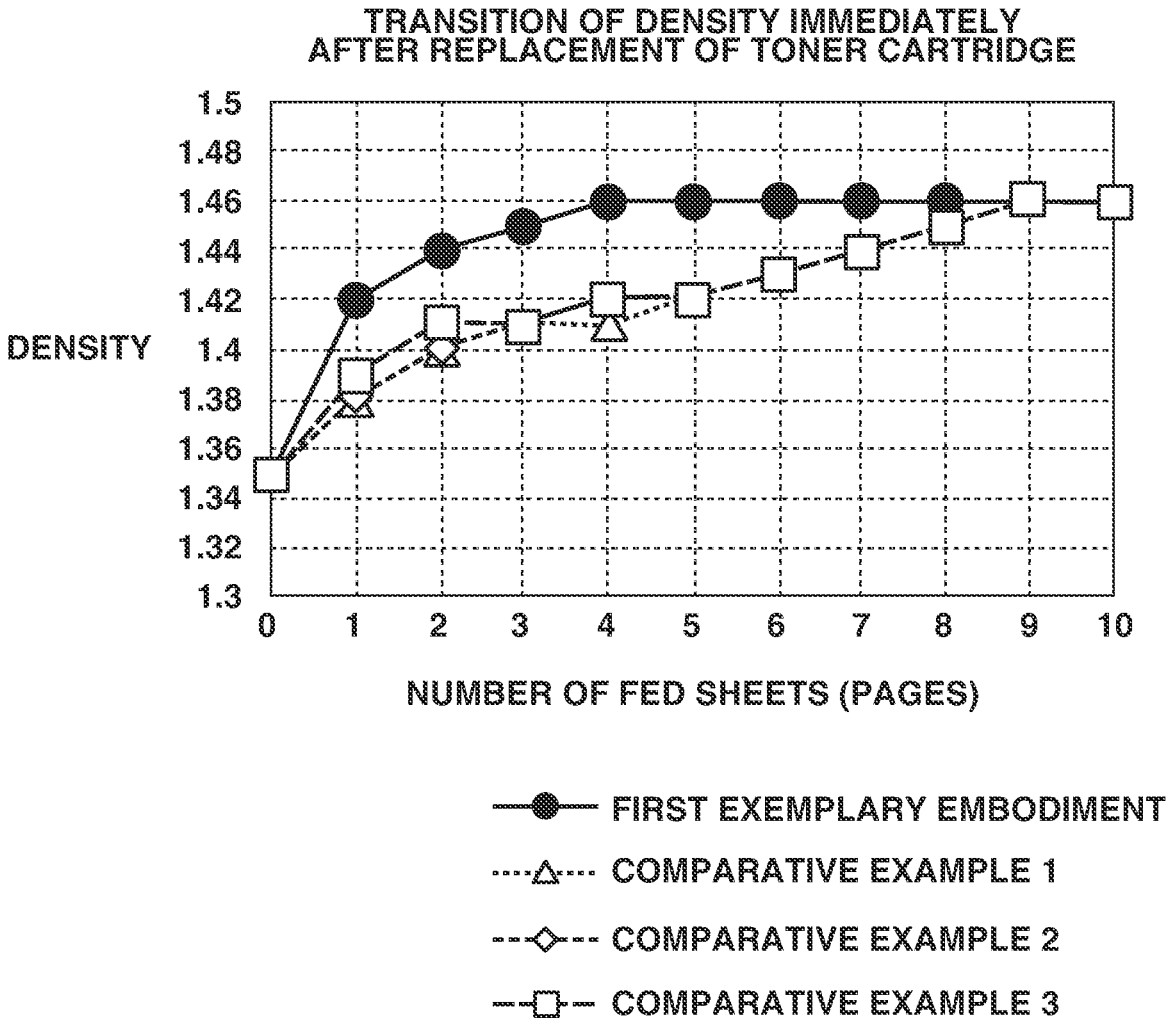
FIG. 14 is a graph illustrating a relationship between the number of fed sheets and transition of image density after the toner cartridge is replaced in the first exemplary embodiment of the present disclosure and the comparative examples 1 to 3.
Figure 15A:
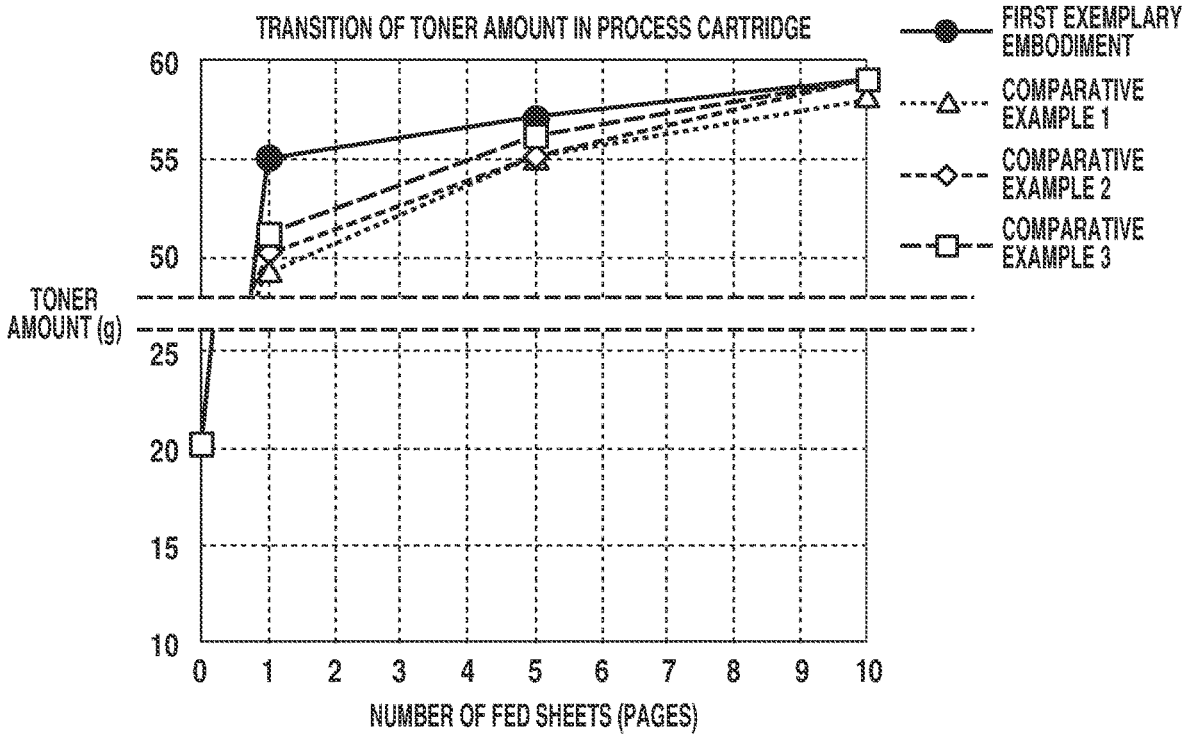
FIG. 15A is a graph illustrating a relationship between the number of fed sheets and transition of an accumulated amount of toner in the process cartridge after replacement of the toner cartridge in each of the first exemplary embodiment of the present disclosure and the comparative examples 1 to 3.
Figure 15B:
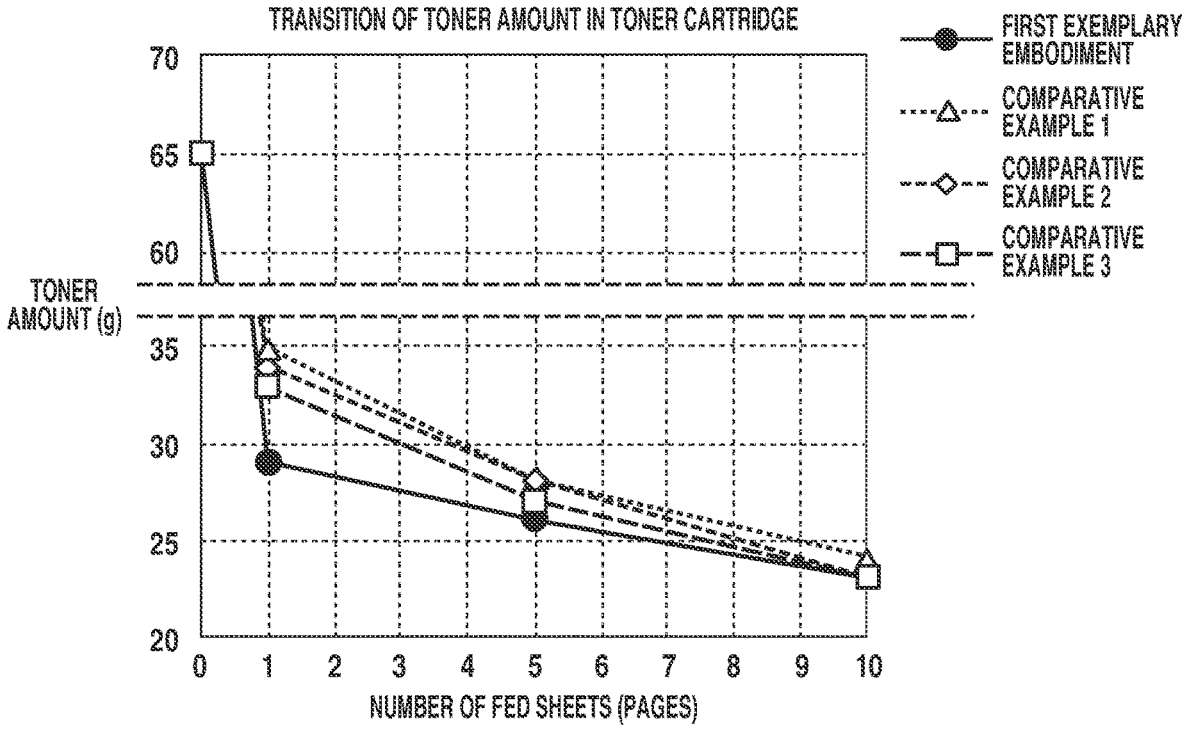
FIG. 15B is a graph illustrating a relationship between the number of fed sheets and transition of a remaining amount of toner in the toner cartridge after replacement of the toner cartridge in each of the first exemplary embodiment of the present disclosure and the comparative examples 1 to 3.

FIG. 14 is a graph illustrating a relationship between the number of fed sheets and transition of image density after replacement of the toner cartridge in each of the first exemplary embodiment of the present disclosure and the comparative examples 1 to 3. FIG. 15A is a graph illustrating a relationship between the number of fed sheets and transition of an accumulated amount of toner in the process cartridge after replacement of the toner cartridge in each of the present exemplary embodiment of the present disclosure and the comparative examples 1 to 3. FIG. 15B is a graph illustrating a relationship between the number of fed sheets and transition of a remaining amount of toner in the toner cartridge after replacement of the toner cartridge in each of the first exemplary embodiment and the comparative examples 1 to 3.

FIG. 14 illustrates transition of density of a solid image. FIGS. 15A and 15B illustrate transition of a remaining amount of toner in each of the process cartridge and the toner cartridge.

Each of the graphs in FIGS. 14, 15A, and 15B is plotted by setting the number of printed sheets immediately before and after replacement as "0" and "1", respectively. An amount of toner in the process cartridge immediately before replacement is 20 g, and an amount of toner in the new toner cartridge is 65 g.

As illustrated in FIG. 14, in the present exemplary embodiment, a density exceeds an index 1.4 at the first sheet immediately after replacement, and the density becomes almost stable at the fifth sheet. On the contrary, in each of the comparative examples 1 to 3, a density does not attain the index 1.4 at the first sheet, and the image density equivalent to the image density of the present exemplary embodiment can only be acquired when nearly 10 sheets are fed thereto.

As described above, according to the configuration of the present exemplary embodiment, after the toner cartridge is replaced, the first hopper unit 4 is efficiently replenished with developer, so that an image can be stably and promptly formed.

Further, as illustrated in FIG. 15A, the toner cartridge is replaced when the remaining amount of toner in the process cartridge is 20 g. An amount of toner in the process cartridge when a first sheet is printed immediately after replacement (i.e., an accumulation amount after replenishment) in each of the comparative examples 1 to 3 is less than that of the present exemplary embodiment.

Further, as illustrated in FIG. 15A, an amount of toner that is accumulated in the process cartridge when 10 sheets are printed after replacement of the toner cartridge (replenishment of toner) in the comparative example (e.g., comparative example 1) has already been achieved when approximately five sheets are printed in the present exemplary embodiment.

Further, as illustrated in FIG. 15B, in each of the present exemplary embodiment and the comparative examples 1 to 3, an amount of toner stored in the toner cartridge is 65 g when replenishment is started. When the toner cartridge is attached to the process cartridge, supply (replenishment) of toner is started with respect to the first hopper unit 4.

A remaining amount of toner in the toner cartridge when a first solid mage (an image of a printing rate 100%) is printed immediately after attachment of the toner cartridge in each of the comparative examples 1 to 3 is greater than that of the present exemplary embodiment. Therefore, it was found that replenishing efficiency in the present exemplary embodiment was superior to the others.

It was also found that a toner decrease rate (i.e., replenishing efficiency) for printing of up to 10 sheets in each of the comparative examples 1 to 3 was more moderate (i.e., lower) than in the present exemplary embodiment.

From the above-described data about transition of density and transition of the remaining amount of toner, it was found that replenishing efficiency of toner of the present exemplary embodiment was higher than that of each of the comparison examples 1 to 3.

In other words, in the present exemplary embodiment, toner can be promptly supplied to the process cartridge immediately after replacement of the toner cartridge. As a result, density of a solid image which has been lowered immediately before replacement can resume promptly, so that high-quality image formation is stably executed.

Next, comparative experiments were conducted with respect to the rotation period of the agitation member 8 after attachment of the toner cartridge to the process cartridge and change of image density.

Figure 16:
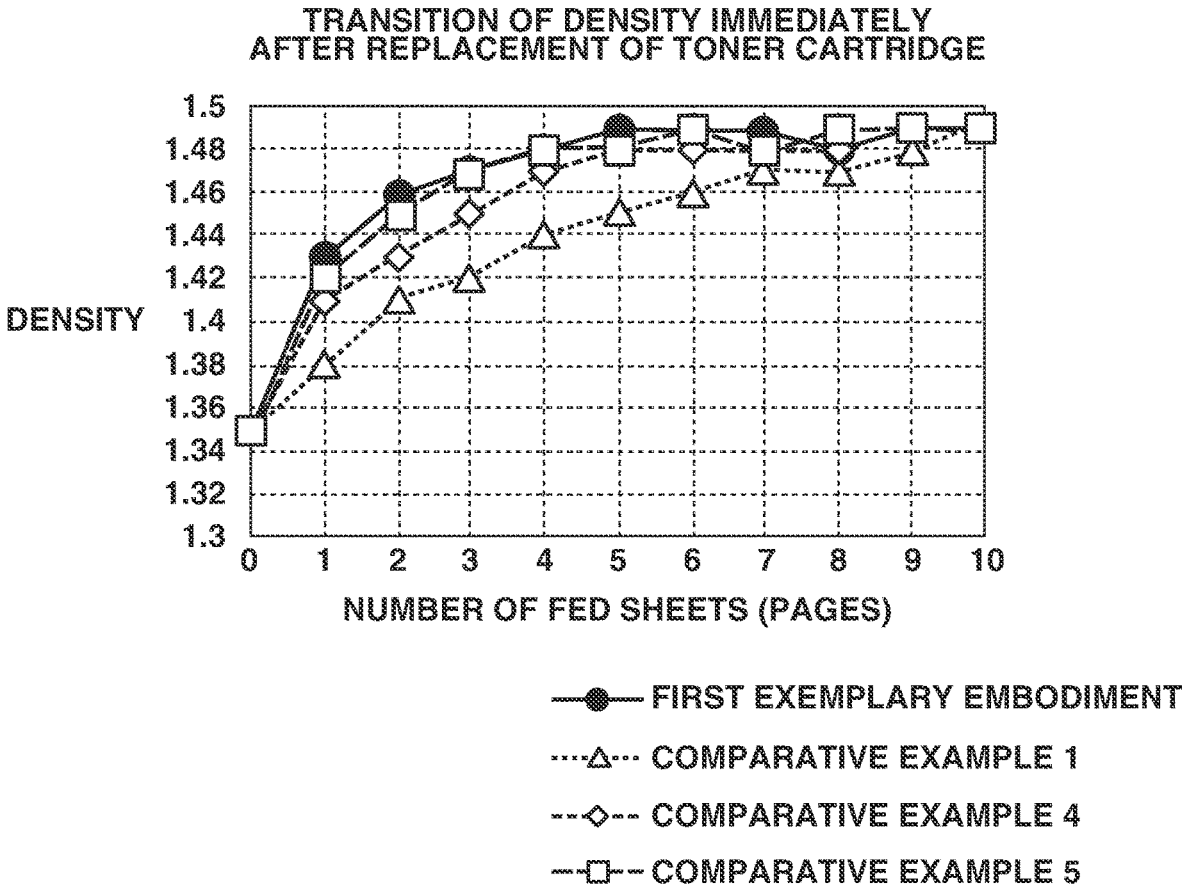
FIG. 16 is a graph illustrating a relationship between the number of fed sheets and transition of image density after replacement of the toner cartridge in each of the first exemplary embodiment of the present disclosure and the comparative examples 1, 4, and 5.
Figure 17A:
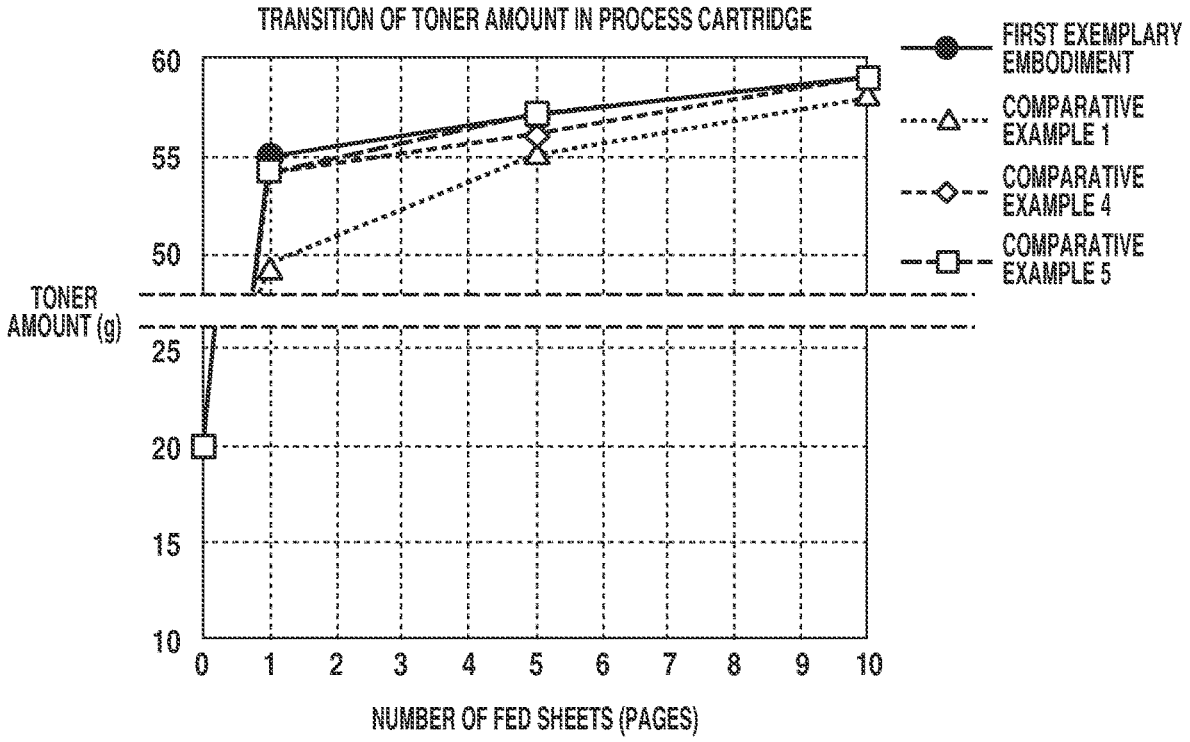
FIG. 17A is a graph illustrating a relationship between the number of fed sheets and transition of an accumulated amount of toner in the process cartridge after replacement of the toner cartridge in each of the first exemplary embodiment of the present disclosure and the comparative examples 1, 4, and 5.
Figure 17B:
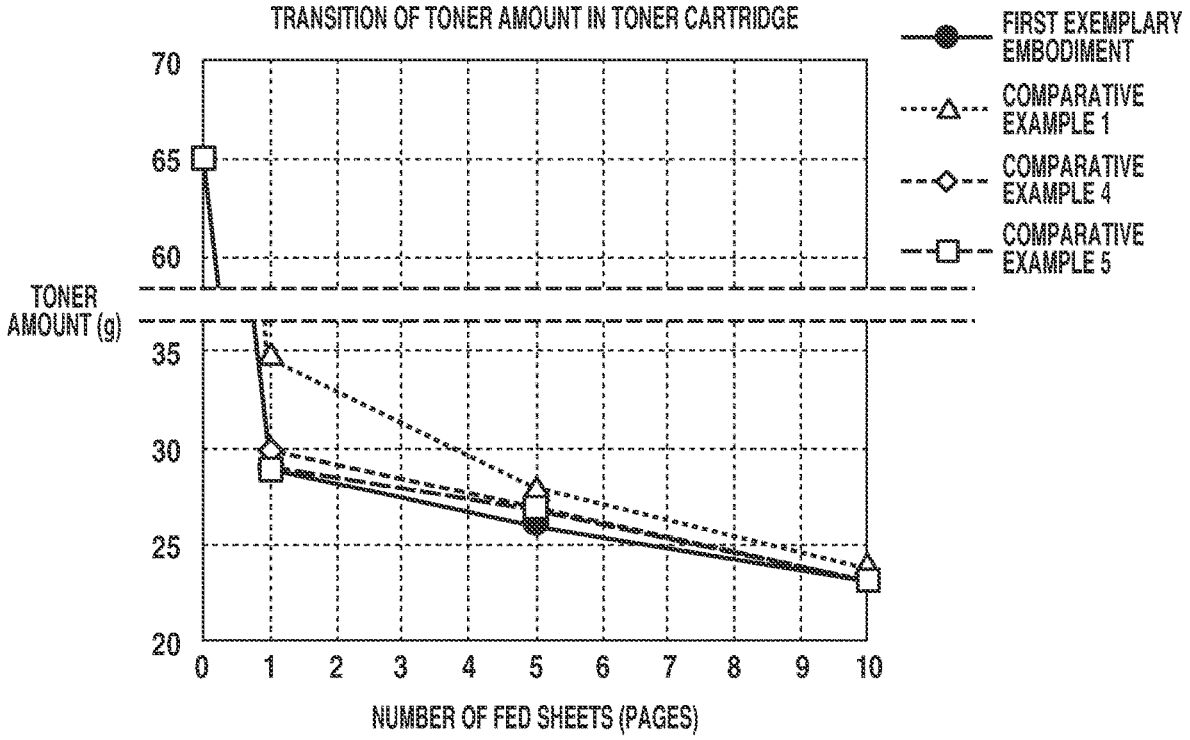
FIG. 17B is a graph illustrating a relationship between the number of fed sheets and transition of a remaining amount of toner in the toner cartridge after replacement of the toner cartridge in each of the first exemplary embodiment of the present disclosure and the comparative examples 1, 4, and 5.

Specifically, with respect to the cases where the rotation period after attachment of the toner cartridge was 20 sec. (the same condition as the comparative example 1), 60 sec. (comparative example 4), and 120 sec. (comparative example 5), in the configuration of the first hopper unit 4 of the comparative example 1, the present exemplary embodiment (rotation period of 20 sec.) was compared to the comparative examples FIG. 16 is a graph illustrating a relationship between the number of fed sheets and transition of image density after replacement of the toner cartridge in each of the first exemplary embodiment of the present disclosure and the comparative examples 1, 4, and 5. FIG. 17A is a graph illustrating a relationship between the number of fed sheets and transition of an accumulated amount of toner in the process cartridge after replacement of the toner cartridge in each of the present exemplary embodiment of the present disclosure and the comparative examples 1, 4, and 5. FIG. 17B is a graph illustrating a relationship between the number of fed sheets and transition of a remaining amount of toner in the toner cartridge after replacement of the toner cartridge in each of the present exemplary embodiment and the comparative examples 1, 4, and 5 of the present disclosure.

Specifically, FIG. 16 illustrates transition of image density associated with an increase of the number of printed solid images. Further, FIGS. 17A and 17B respectively illustrate transition of a remaining amount of toner in each of the process cartridge and the toner cartridge.

In the comparative examples 4 and 5, the rotation period was respectively extended to 60 sec. and 120 sec. from 20 sec., so that transition of density became relatively stable, compared to the comparative example 1. Further, it was found that a result similar to the first exemplary embodiment was acquired with respect to transition of the remaining amount when the rotation period is extended.

In the present exemplary embodiment, the rotation period was 20 sec. However, in the comparative examples 4 and 5, the rotation period was extended by 40 sec. and 100 sec. respectively, so that additional time was required. In comparison to the comparative examples 4 and 5, in the present exemplary embodiment, time necessary for acquiring a first image after replacement of the toner cartridge, having quality as good as that of an image acquired before replacement, can be shortened reliably, and replenishing efficiency is good.

Variation Example

Next, a variation example of the concave portion arranged on the first hopper unit will be described.

FIGS. 18A to 18D are conceptual cross-sectional diagrams illustrating the hopper units according to variation examples 1 to 4 of the present exemplary embodiment of the present disclosure. FIG. 19 is a conceptual cross-sectional diagram illustrating the hopper unit according to a variation example 5 of the present exemplary embodiment of the present disclosure. FIGS. 20A to 20D are conceptual cross-sectional diagrams illustrating the hopper unit according to a variation example 6 of the present exemplary embodiment of the present disclosure.

Figure 22:
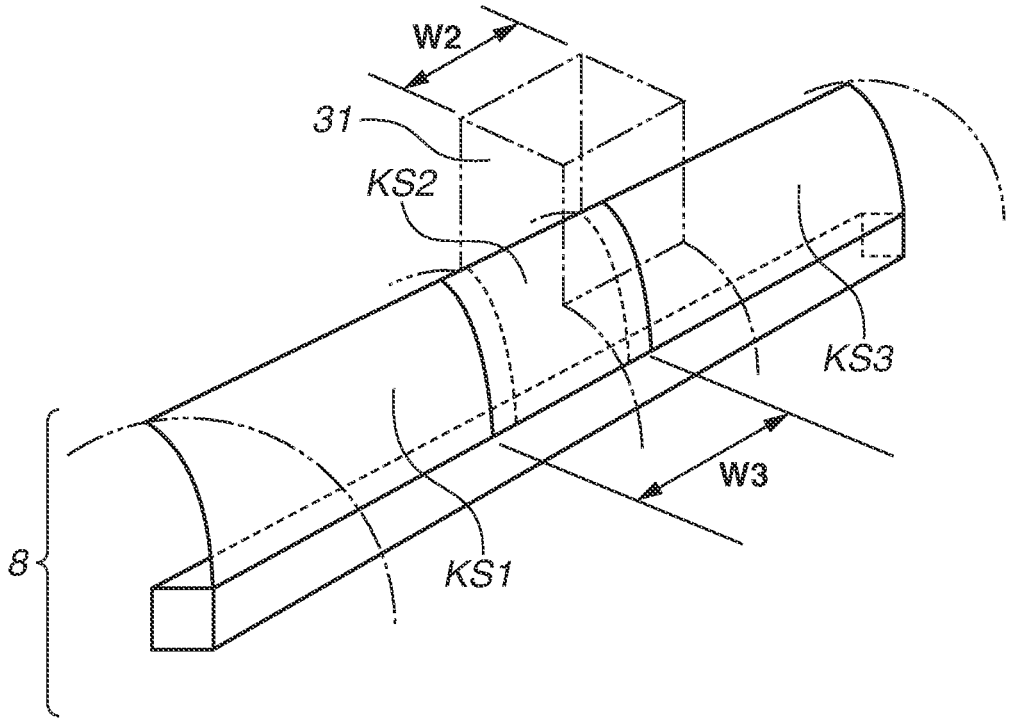
FIG. 22 is a conceptual perspective diagram illustrating an agitation member and a concave portion according to a variation example 8 of the first exemplary embodiment of the present disclosure.
Figure 23:
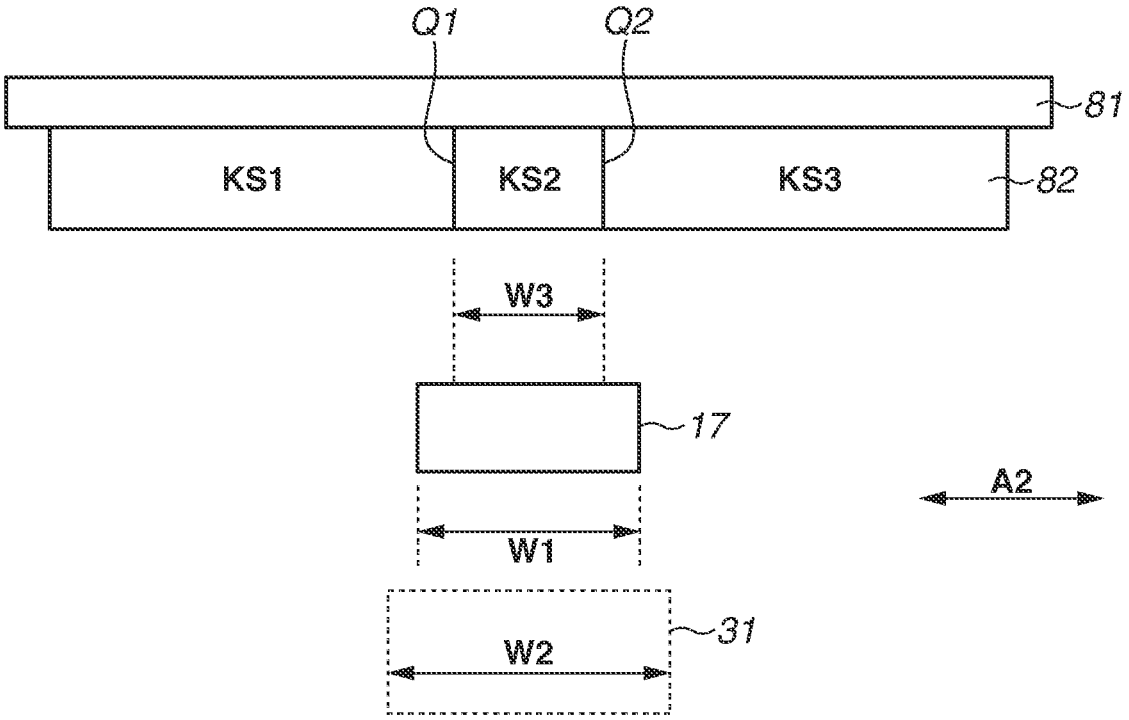
FIG. 23 is a conceptual diagram illustrating a positional relationship between an agitation member, a supply port, and a concave portion according to a variation example 9 of the first exemplary embodiment of the present disclosure.
Figure 24:
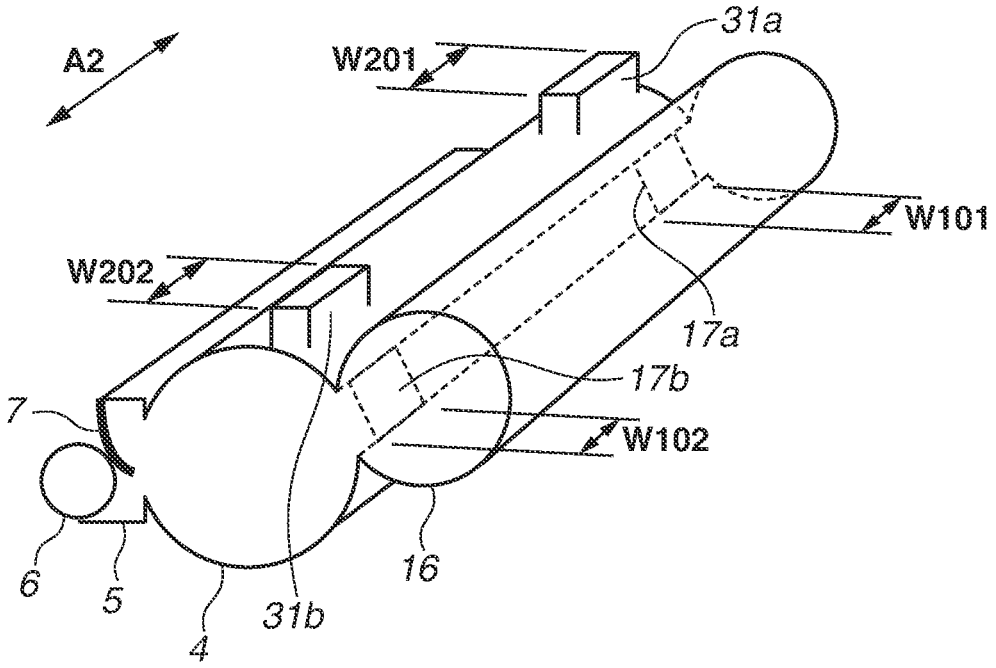
FIG. 24 is a conceptual perspective diagram illustrating a development device used for an image forming apparatus according to a second exemplary embodiment of the present disclosure, to which a toner cartridge is attached.

FIGS. 21A to 21D are conceptual cross-sectional diagrams illustrating the hopper unit according to a variation example 7 of the present exemplary embodiment of the present disclosure. FIG. 22 is a conceptual perspective diagram illustrating the agitation member and the concave portion according to a variation example 8 of the present exemplary embodiment of the present disclosure. FIG. 23 is a conceptual diagram illustrating a positional relationship between the agitation member, the supply port, and the concave portion according to a variation example 9 of the present exemplary embodiment of the present disclosure.

First, variation examples of the convex portion illustrated in FIGS. 18A to 18D will be described.

Figure 18A:
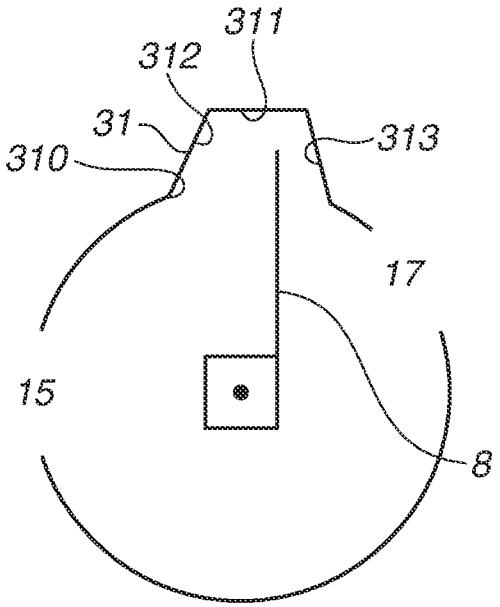
FIGS. 18A to 18D are conceptual cross-sectional diagrams illustrating hopper units according to the first exemplary embodiment and variation examples 1 to 4 of the present disclosure.
Figure 19:
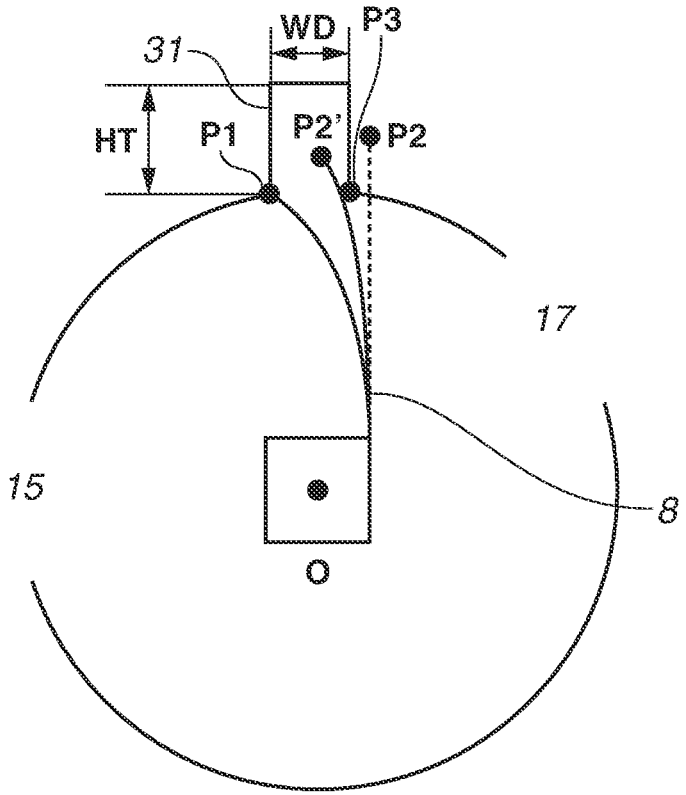
FIG. 19 is a conceptual cross-sectional diagram illustrating a hopper unit according to a variation example 5 of the first exemplary embodiment of the present disclosure.

In the variation example 1, as illustrated in FIG. 18A, in an in-use orientation, the upstream side face 312 and the downstream side face 313 of the concave portion 31 are inclined toward the bottom face 311, when viewed from an axis direction of the rotation shaft. Specifically, the bottom face 311 is arranged in a horizontal direction, and each of the side faces 312 and 313 makes an obtuse angle with the bottom face 311. With this configuration, toner can easily fall downward from the opening 310 when the sheet portion 82 enters the concave portion 31.

Figure 18B:
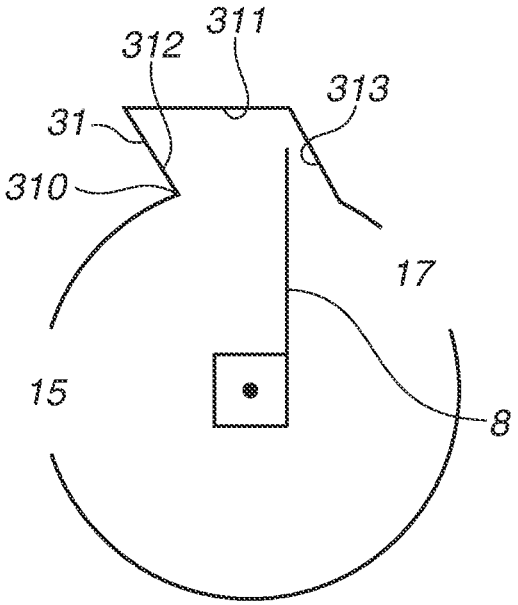

In the variation example 2, as illustrated in FIG. 18B, the bottom face 311 is arranged in the horizontal direction, the upstream side face 312 is arranged to make an acute angle with the bottom face 311, and the downstream side face 313 is formed to make an obtuse angle with the bottom face 311. Similar to the configuration described in the variation example 1, toner can easily fall downward from the opening 310 when the sheet portion 82 enters the concave portion 31.

Further, in the variation example 2, because the upstream side face 312 makes an acute angle with the bottom face 311, there is a case where toner is accumulated on the upstream side face 312 inclined upward. In order to reduce the accumulation of toner, it is preferable that an inclination angle of the side face 312 with respect to the horizontal direction be greater than or equal to a repose angle of toner.

Figure 18C:
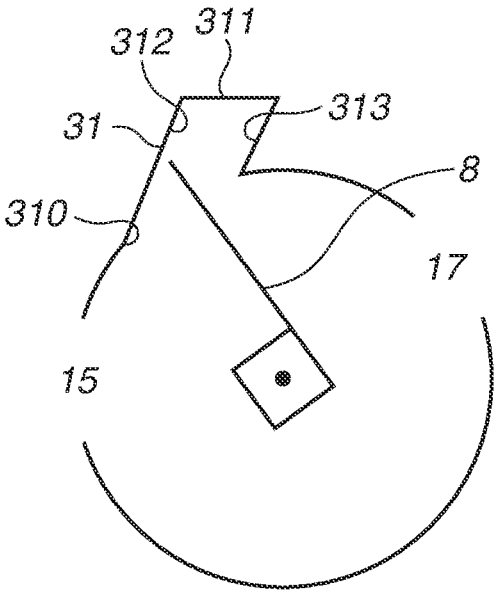

Further, in the variation example 3, as illustrated in FIG. 18C, the upstream side face 312 is formed to make an obtuse angle with the bottom face 311, and the downstream side face 313 is formed to make an acute angle with the bottom face 311. When the sheet portion 82 enters the concave portion 31, toner can fall downward from the opening 310 along the inclination of the downstream side face 313, so that backflow of toner to the supply port 17 can be eventually reduced.

Similar to the variation example 2, in order to reduce the accumulation of toner, it is preferable that an inclination angle of the downstream side face 313 with respect to the horizontal direction be greater than or equal to the repose angle of toner.

Figure 18D:
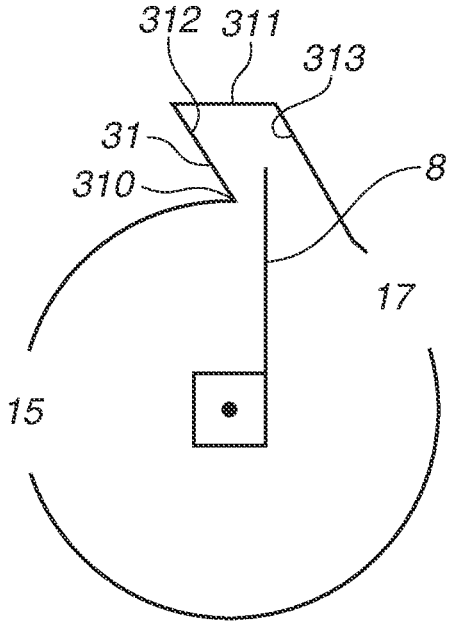

As illustrated in FIG. 18D, in the variation example 4, although a width of the opening 310 is narrower than a width of the opening 310 in the variation example 2, it is possible to acquire an effect of releasing the warp of the sheet portion 82 and making toner fall downward, approximately similar to the effect acquired in the variation example 2.

In each of the variation examples 1 to 4, the upstream side face 312 and the downstream side face 313 are inclined with respect to the bottom face 311. However, any one of the side faces on the upstream side and the downstream side may be arranged in an inclined state, and the other side face may be arranged in a vertical direction or a direction orthogonal to the bottom face 311.

As described above, the side faces on the upstream side and the downstream side of the concave portion 31 can be arranged in a direction orthogonal to the horizontal direction. In contrast to the variation examples 1 to 4, in the present exemplary embodiment, the side faces are arranged in a vertical direction orthogonal to the horizontal direction. With this configuration, a warp of the sheet portion 82 can be released most efficiently, so that toner can fall downward promptly.

Next, a variation example 5 will be described with reference to FIG. 19. In the variation example 5, the opening 310 of the concave portion 31 has a narrow width.

In the variation example 5, as illustrated in FIG. 19, although a height HT of the concave portion 31 (i.e., a distance from the opening 310 to the bottom face 311) is the same as that of the first exemplary embodiment, a width WD of the opening 310 is narrower than that of the first exemplary embodiment.

Accordingly, in the variation example 5, after the sheet portion 82 passes the upstream position P1 of the concave portion 31, a warp of a section thereof is released. A leading end of the sheet portion 82 reaches the downstream position P3 of the concave portion 31 before reaching the position P2, so that the sheet portion 82 is regulated (warped) again. Therefore, in the variation example 5, as illustrated by a solid line, the leading end of the sheet portion 82 is brought into a state P2'.

In the variation example 5, a warp of the sheet portion 82 is partially released, so that toner can fall downward. Therefore, although the effect is not as much as the effect acquired in the first exemplary embodiment, suppression effect can be also acquired with respect backflow of toner to the supply port 17.

Next, a variation example 6 will be described with reference to FIGS. 20A to 20D. In the variation example 6, the concave portion 31 has a height HT lower than that of the first exemplary embodiment.

Figure 20A:
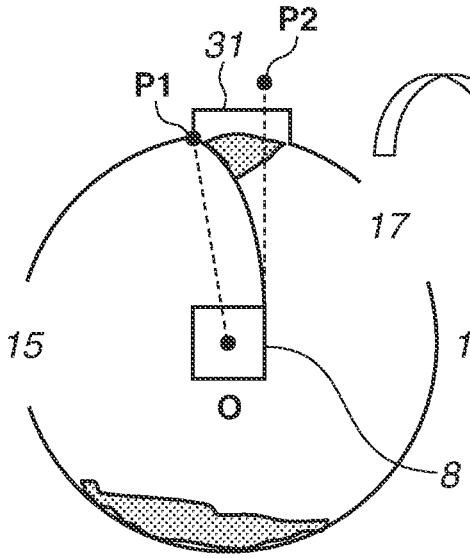
FIGS. 20A to 20D are conceptual cross-sectional diagrams illustrating a hopper unit according to a variation example 6 of the first exemplary embodiment of the present disclosure.
Figure 20B:
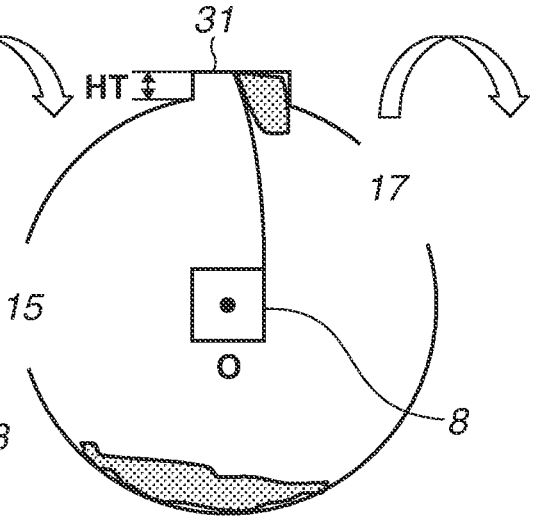
Figure 20C:
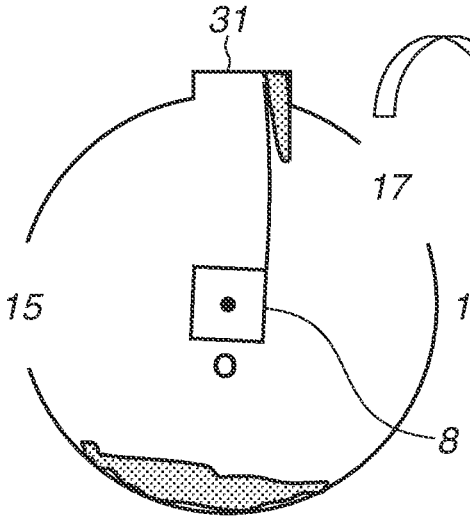
Figure 20D:
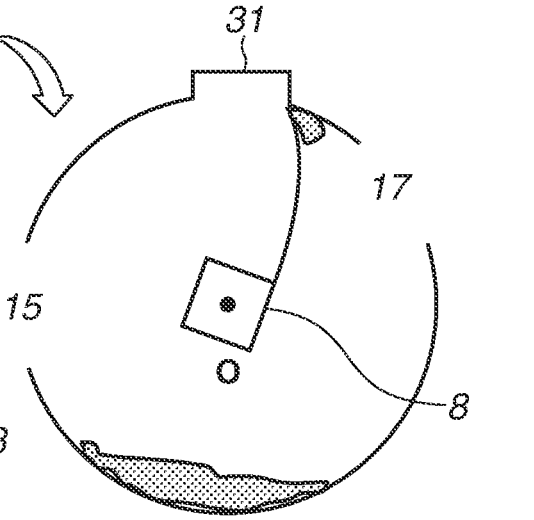

As illustrated in FIG. 20A, after a free end of the sheet portion 82 passes the upstream position P1 of the concave portion 31, a warp of a section thereof is released. A leading end of the sheet portion 82 abuts on the bottom face of the concave portion 31 again before reaching the position P2, so that the leading end of the sheet portion 82 is regulated and starts warping again.

In the variation example 6, because a warp of the sheet portion 82 is partially released, suppression effect can be acquired with respect backflow of toner to the supply port 17, although the effect is not as much as the effect acquired in the first exemplary embodiment.

In addition, the following elements A to D were studied with respect to improvement in releasing performance of the warped sheet portion 82 in the concave portion 31.

A. The rotation radius of the sheet portion 82.

B. A distance from the concave portion 31 to the rotation center of the agitation member 8.

C. An entering amount of the sheet portion 82 at the container face of the first hopper unit 4 on the upstream side of the concave portion 31 in the rotation direction of the agitation member 8.

D. An opening width WD of the concave portion 31 in the rotation direction of the agitation member 8.

The respective elements A to D will be described in detail.

First, in order to reliably release the warp of the sheet portion 82 at the concave portion 31, it is preferable that the elements A and B satisfy a relationship A<B.

If the entering amount (C) is small, the width WD (D) can be also small because a changing amount of the warp is small when the sheet portion 82 passes the upstream of the concave portion 31. However, if the entering amount (C) is large, it is preferable that the width WD (D) be large because the changing amount of the warp is increased. Accordingly, the element D can be set in proportion to the element C. Alternatively, the element C can be set in proportion to the element D.

Figure 21A:
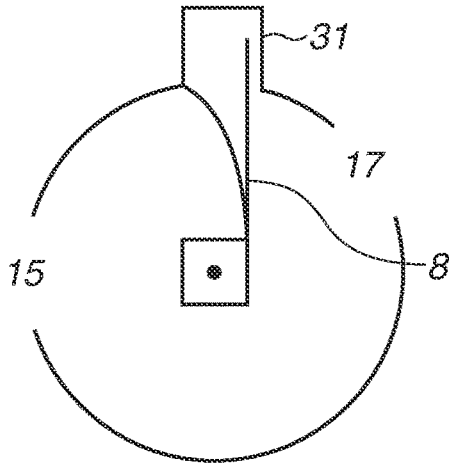
FIGS. 21A to 21D are conceptual cross-sectional diagrams illustrating a hopper unit according to a variation example 7 of the first exemplary embodiment of the present disclosure.
Figure 21B:
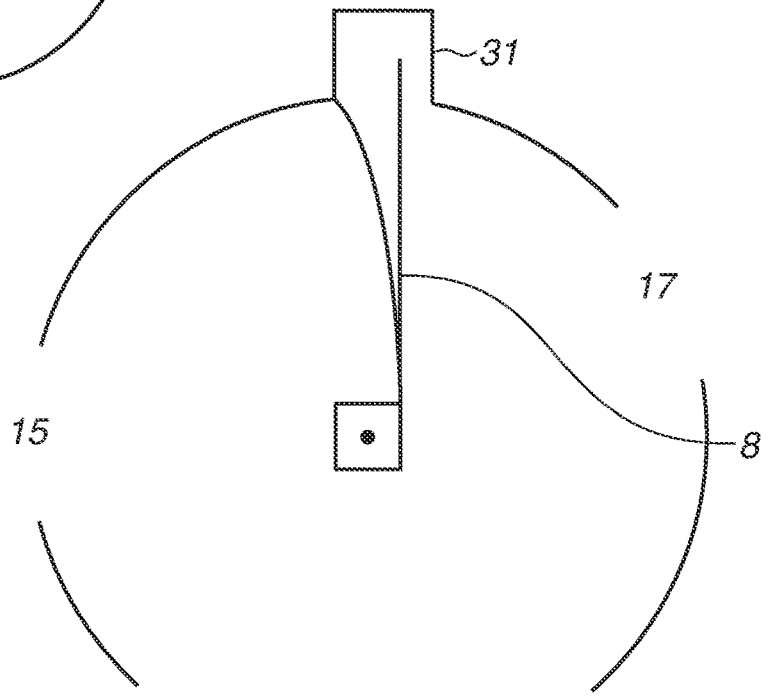

In each of FIGS. 21A and 21B, the concave portion 31 is arranged for a sheet portion having a same entering amount (element C) with a different rotation radius (element A).

As illustrated in FIGS. 21A and 21B, when the entering amount is the same, the rotation radius has a small influence on the opening width of the concave portion 31. In other words, if the entering amount is the same, the opening width can be the same.

Figure 21C:
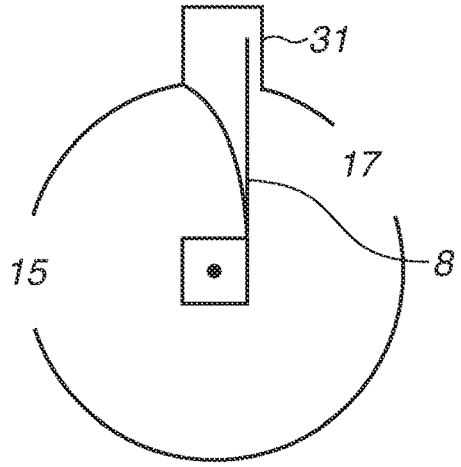
Figure 21D:
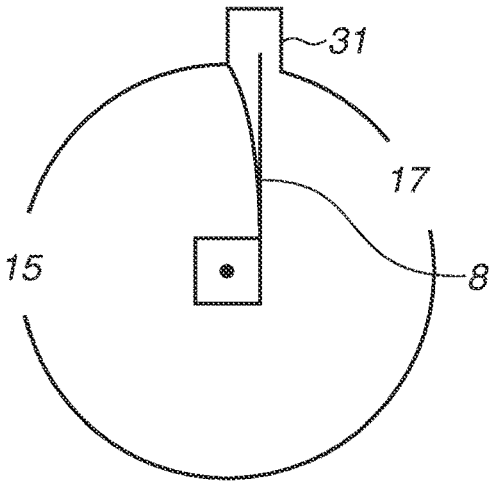

On the other hand, as illustrated in FIGS. 21C and 21D, even if the sheet portion 82 has the same rotation radius, an opening width of the concave portion 31 should be increased if the entering amount is greater. In other words, if the entering amount is greater, a leading end of the sheet portion 82 is moved by a greater distance when the warp is loosened. Therefore, it is preferable that the opening width of the concave portion 31 be wider.

<Widths of Supply Port, Sheet Portion, and Concave Portion>

A warp of the sheet portion 82 has to be reliably released at the concave portion 31. As illustrated in FIG. 22, if the width W3 of the section KS2 of the sheet portion 82 adjacent to the supply port 17 is greater than the width W2 of the concave portion 31, the section KS2 of the sheet portion 82 cannot enter the concave portion 31 easily, so that the section KS2 is likely to remain in a warped state similar to the state of the section KS1 or KS3. This is not preferable because the warp of the section KS2 is not sufficiently released, or is held in a state the same as that of the section KS1 and KS3. Therefore, it is preferable that the respective widths satisfy the relationship W2≥W3.

On the other hand, as illustrated in FIG. 23, if the width W3 of the section KS2 (central section) of the sheet portion 82 is smaller than the width W1 of the supply port 17, the sections KS1 and KS3 (both side sections) of the sheet portion 82 become adjacent to the supply port 17.

Although the section KS2 of the sheet portion 82 of the agitation member 8 enters the concave portion 31, the sections KS1 and KS3 cannot enter the concave portion 31. Therefore, warps of the sections KS1 and KS3 of the sheet portion 82 are not released. This is not preferable because the sections KS1 and KS3 of the sheet portion 82 may convey toner to the supply port 17 in the vicinities of the both end portions of the supply port 17 facing the sections KS1 and KS3. Therefore, it is preferable that the respective widths satisfy the relationship W3≥W1.

Accordingly, it is more preferable that the respective widths satisfy the relationship W2≥W3≥W1.

According to the present exemplary embodiment, a section of the agitation member 8 which passes the vicinity area of the supply port 17 enters the concave portion 31 arranged on the upstream side of the supply port 17, so that a warp of that section of the sheet portion 82 can be released. Further, toner borne on the section of the sheet portion 82 collides with the side face or the bottom face of the concave portion 31, so that toner can fall in the inner portion of the first hopper unit 4 before the agitation member 8 comes close to the supply port 17.

With this configuration, even if the sheet portion 82 reaches the vicinity area of the supply port 17, toner is less likely to be conveyed to the toner cartridge from the supply port 17 because the amount of toner borne on the sheet portion 82 is reduced.

As a result, toner supplied from the toner cartridge is prevented from flowing back to the toner cartridge. With this configuration, supply (replenishment) of toner to the first hopper unit 4 can be stably executed, and a rotation (charging) period after replacement (attachment) of a new toner cartridge can be shortened when the toner cartridge is replaced. Therefore, it is possible to restart the image forming operation stably and promptly immediately after the toner cartridge is replaced.

A second exemplary embodiment of the present disclosure will be described with reference to FIG. 25.

Figure 25:
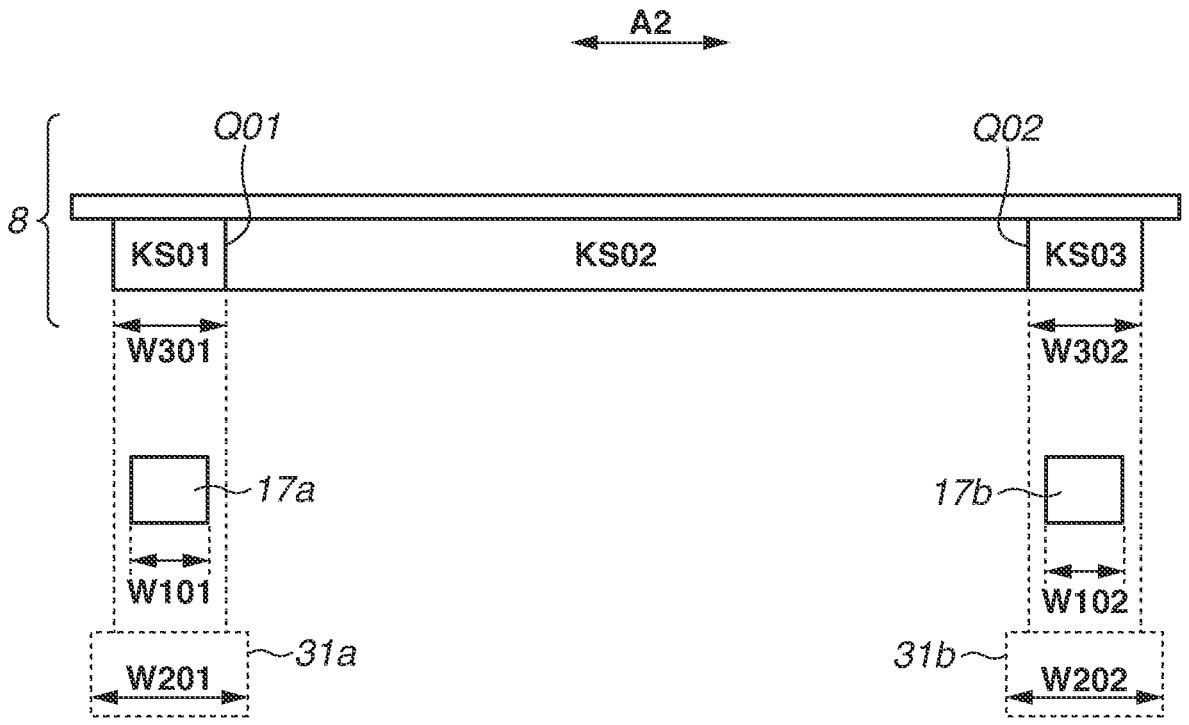
FIG. 25 is a conceptual diagram illustrating a positional relationship between an agitation member, a supply port, and a concave portion of the image forming apparatus according to the second exemplary embodiment of the present disclosure.

FIG. 25 is a conceptual diagram illustrating a positional relationship between an agitation member, supply ports, and concave portions of an image forming apparatus according to the present exemplary embodiment of the present disclosure.

Hereinafter, a configuration different from the first exemplary embodiment will be mainly described. In the present exemplary embodiment, a plurality of supply ports from the toner cartridge is arranged on the hopper unit.

In the above-described first exemplary embodiment, a supply port is arranged on a central portion. The present exemplary embodiment is different from the first exemplary embodiment in that the supply ports are arranged on both end portions instead of the central portion as described in the first exemplary embodiment.

The supply ports are arranged on the end portions because of the following reasons. The end portions are close to margins of an image to be printed, so that not much toner is consumed. Therefore, toner borne on the developer bearing body is borne and regulated continuously without being consumed, so that development performance will be deteriorated. A purpose of the present exemplary embodiment is to replace the toner easily.

As illustrated in FIG. 25, the agitation member 8 of the present exemplary embodiment is divided into three sections by the cuts Q1 and Q2. The three divided sections (areas) of the sheet portion 82 are described as sections KS01, KS02, and KS03. The widths of supply ports 17*a* and 17*b* positioned at both ends are described as widths W101 and W102, and the widths of the sections KS01 and KS03 of the sheet portion 82 corresponding to the supply ports 17*a* and 17*b* are described as widths W301 and W302. In the present exemplary embodiment, the respective widths satisfy relationships "W101≤W301" and "W102≤W302".

Further, concave portions are arranged according to the supply ports 17*a* and 17*b* and the divided areas of the sheet portion 82. Specifically, concave portions 31*a* and 31*b* are arranged according to the supply ports 17*a* and 17*b*.

As described above, when the widths of the concave portions 31*a* and 31*b* are W201 and W202, the respective widths should satisfy the relationships "W201≥W301" and "W202≥W302" in order to acquire a releasing effect on the warp of the sheet portion 82. Further, in a case where three or more supply ports are arranged thereon, concave portions are arranged according to the number of supply ports, and the sheet portion 82 is divided in association with the concave portions. With this configuration, an effect similar to the effect of the first exemplary embodiment can be acquired.

A third exemplary embodiment of the present disclosure will be described with reference to FIGS. 26, 27A, 27B, 28A, and 28B.

Figure 26:
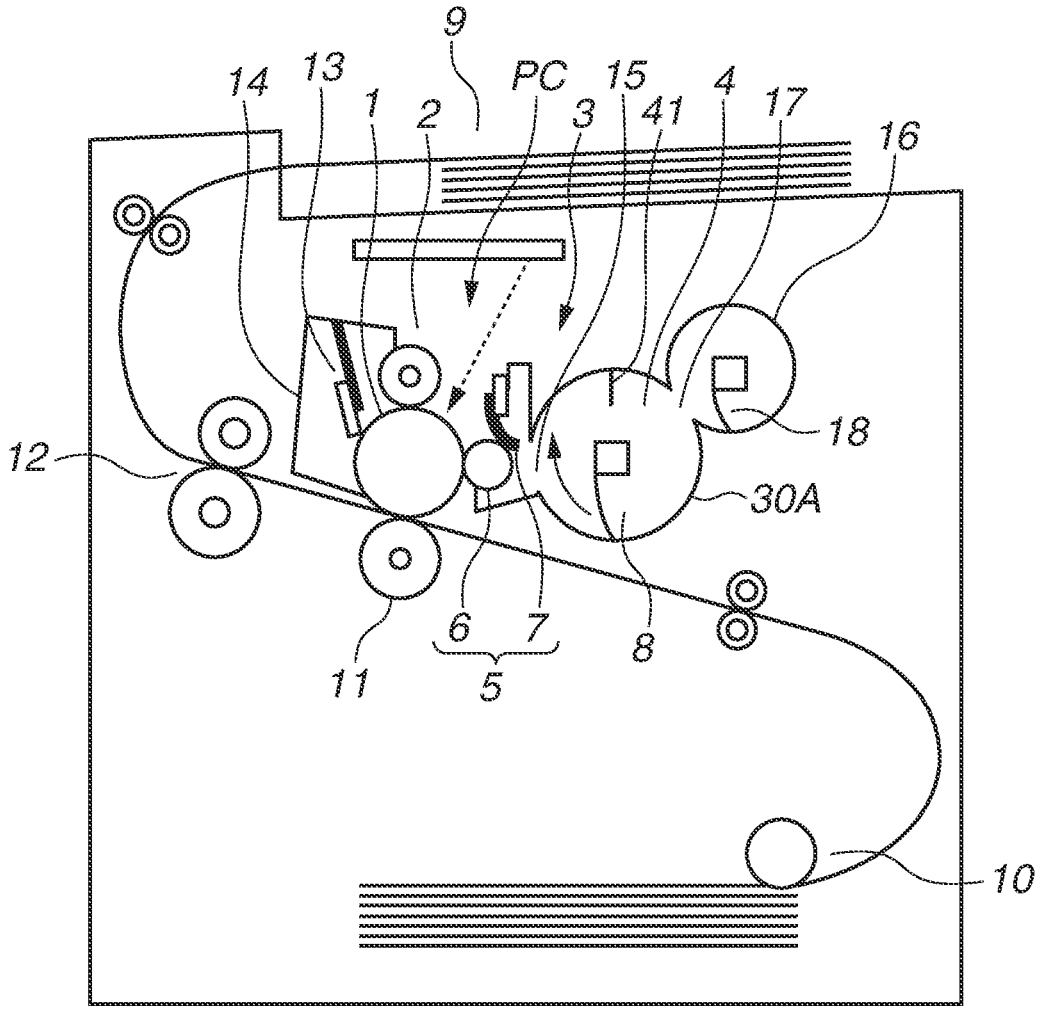
FIG. 26 is a conceptual cross-sectional diagram illustrating an image forming apparatus according to a third exemplary embodiment of the present disclosure.
Figures 27A, 27B:
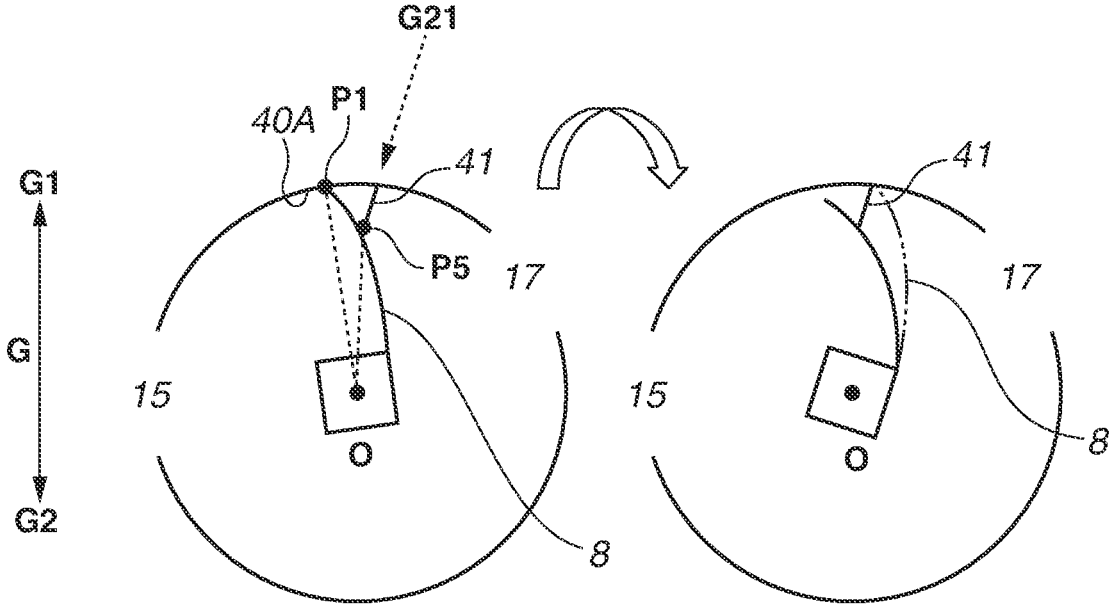
FIGS. 27A and 27B are conceptual diagrams illustrating the movement of an agitation member according to the third exemplary embodiment of the present disclosure.
Figure 28A:
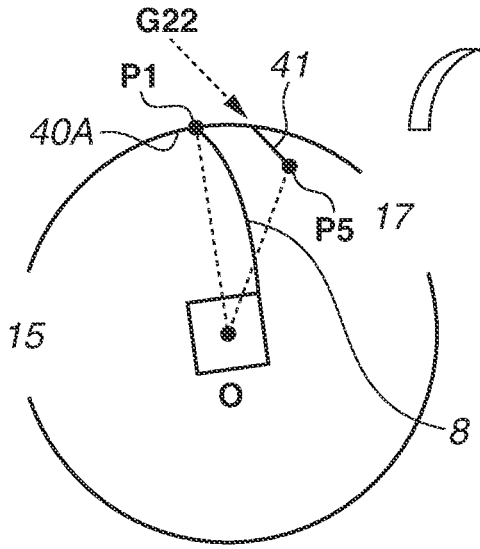
FIGS. 28A and 28B are conceptual diagrams illustrating the movement of the agitation member according to a variation example of the third exemplary embodiment of the present disclosure.
Figure 28B:
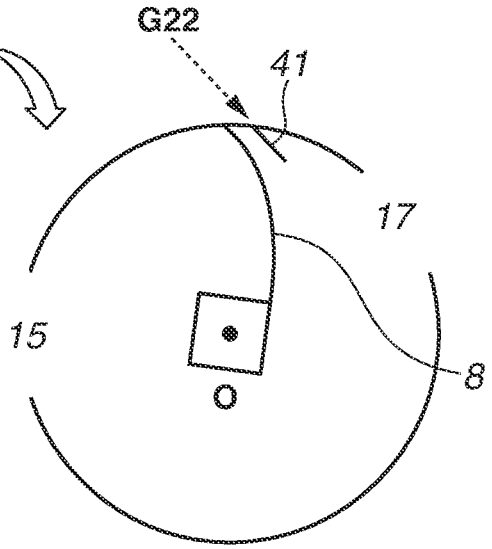

FIG. 26 is a conceptual cross-sectional diagram illustrating an image forming apparatus according to the present exemplary embodiment of the present disclosure. FIGS. 27A and 27B are conceptual diagrams illustrating the movement of the agitation member 8 according to the present exemplary embodiment of the present disclosure. FIGS. 28A and 28B are conceptual diagrams illustrating the movement of the agitation member 8 according to a variation example of the present exemplary embodiment of the present disclosure.

Hereinafter, a configuration different from the first exemplary embodiment will be mainly described.

In the present exemplary embodiment, in order to cancel the warp of the sheet portion 82, a convex portion 41 projected toward the rotation center of the agitation member 8 (i.e., projected toward the inner side) is arranged on the upper side of the first hopper unit 4 instead of the concave portion 31 projected toward the outside as described in the first and second exemplary embodiments.

In the present exemplary embodiment, the agitation member 8 is divided in a same way as the first and the second exemplary embodiments (see FIG. 5), and the section KS2 of the sheet portion 82 is arranged at a position corresponding to the convex portion 41.

The convex portion 41 of the present exemplary embodiment will be described with reference to FIGS. 27A and 27B.

On the upper side of the first hopper unit 4, the convex portion 41 is arranged to project toward the inside from the inner wall face 40A of the first hopper unit 4, at a position downstream of the development opening 15 and upstream of the supply port 17 in the rotation direction of the agitation member 8.

More specifically, a relationship R3<R1 is satisfied when a distance between the position P1 of the leading end of the sheet portion 82 immediately before the sheet portion 82 is in contact with the convex portion 41 and the rotation center O of the agitation member 8 is R1, and a distance between a leading end P5 of the convex portion 41 and the rotation center O of the agitation member 8 is R3. Further, a relationship R1<L is satisfied when a free length of the sheet portion 82 is L. In other words, in the present exemplary embodiment, a relationship R3<R1<L is satisfied.

FIG. 27A illustrates a state immediately before the free end of the sheet portion 82 passes (or abuts on) the convex portion 41. FIG. 27B illustrates a state where the free end of the sheet portion 82 is abutting on the convex portion 41 and a state immediately after the free end thereof passes the convex portion 41.

The toner borne on the sheet portion 82 is scraped off when the leading end of the sheet portion 82 is in contact with the convex portion 41. Further, at the section of the sheet portion 82 which is not in contact with the convex portion 41, a warped state thereof is also changed before and after collision of the sheet portion 82 against the convex portion 41, and vibration occurs in the sheet portion 82. As a result, toner held by the sheet portion 82 can easily fall in the container.

As illustrated in FIGS. 27A and 27B, because the leading end P5 of the convex portion 41 is extended toward the development opening 15 arranged on the opposite side of the supply port 17 from the inner wall face 40A of the first hopper unit 4, toner scraped by the convex portion 41 can easily fall in the area on a side of the development opening 15. Therefore, toner is less likely to fall in the area on a side of the supply port 17.

On the other hand, as illustrated in FIGS. 28A and 28B, in a case where the leading end P5 of the convex portion 41 is extended toward the supply port 17 from the inner wall face 40A of the first hopper unit 4, toner falling from the sheet portion 82 is easily scattered in a direction of the supply port 17. Therefore, in comparison to the configuration illustrated in FIGS. 27A and 27B, toner is more likely to flow back to the supply port 17. Therefore, the configuration illustrated in FIGS. 27A and 27B is preferable when the convex portion 41 is to be formed thereon.

In addition, although it is not illustrated, a magnitude relationship (not illustrated) between the widths of the convex portion 41, the section KS2 of the sheet portion 82, and the supply port 17 in the rotation axis direction A2 is basically the same as the relationship described in the first exemplary embodiment in which the concave portion 31 is arranged thereon.

Further, in the configuration described in the present exemplary embodiment, by changing the warped state of the sheet portion 82, toner borne on the sheet portion 82 can also fall in the container before the sheet portion 82 reaches the vicinity area of the supply port 17. With this configuration, an amount of toner scattering in a direction of the supply port 17 can be reduced. Therefore, similar to the first and the second exemplary embodiments, effect of improving the replenishing efficiency can be acquired when toner is supplied from the toner cartridge.

<Others>

The development device described in the present exemplary embodiment may constitute a part of the process cartridge or the image forming apparatus. The process cartridge may constitute a part of the image forming apparatus. The toner cartridge serving as a part of the development device may constitute a new cartridge or a process cartridge.

The configuration according to the present disclosure can be summarized as follows.

1. A development device (3) according to the present disclosure includes a development frame body (30A) and an agitation member (8), and a developer replenishing device (16) for replenishing developer to a developer containing chamber via a replenishing port (17) can be attached to and detached from the development frame body (30A).

The development frame body (30A) includes a development chamber (5) in which a developer bearing body (6) for bearing developer is housed, a developer containing chamber (4) for storing developer to be supplied to the development chamber (5), and a replenishing port (17) through which the developer containing chamber (4) can be replenished with developer from the outside, the developer containing chamber (4) having a communication port (15) for communicating with the development chamber (5).

An agitation member (8) is housed in the developer containing chamber (4), and includes a rotatable shaft portion (81) and an elastically-deformable sheet portion (82), one end of the sheet portion is fixed to the shaft portion as a fixed end (821), and the other end of the sheet portion is a free end (822).

The development frame body (30A) for constructing the developer containing chamber (4) includes a concave portion (31) formed by projecting from an inner wall face (40A) of the development frame body (30A), in a direction (G11) along an upward direction (G1) of a gravitational direction (G) in an in-use orientation, and the concave portion is located at a downstream side of the communication port and an upstream side of the replenishing port (17) in a rotation direction (A1) of the agitation member (8).

The concave portion (31) and the replenishing port (17) overlap with each other at least at one part (W100) in an axis direction (A2) of the shaft portion, when viewed in a direction (A3) orthogonal to the axis direction (A2) of the shaft portion, a relationship R1≤L is satisfied when a free length from the fixed end (821) to the free end (822) of the sheet portion (82) is L and a distance from a rotation center (O) of the shaft portion to the inner wall face (40A) is R1, and slit portions (Q1 and Q2) are formed in the free end (822) of the sheet portion (82), so that a section (KS2) of the free end (822) of the sheet portion (82) is able to enter the concave portion (31) when the agitation member (8) is rotated.

In addition, the slit portion may be formed to extend in a direction along a direction heading toward the free end (822) from the fixed end (821) of the sheet portion (82). Further, the first and second slit portions Q1 and Q2 may be arranged in parallel in the axis direction (A2). Then, the first and second slit portions Q1 and Q2 may be formed to extend in the entire area from the free end (822) to the fixed end (821), or may be formed only on a side of the free end (822).

2. In the development device (3) of the present disclosure, a relationship W1≤W2 is satisfied, when a width of the replenishing port (17) is W1 and a width of the concave portion (31) is W2 in the axis direction (A2), and an area (W1) of the replenishing port (17) may be arranged not to exceed an area (W2) of the concave portion (31) in the axis direction (A2) when viewed in a direction orthogonal to the axis direction (A2).

3. In the development device (3) of the present disclosure, the first slit portion (Q1) and the second slit portion (Q2) are formed in the sheet portion (82), a relationship W1≤W3≤W2 is satisfied, when a distance between the first slit portion (Q1) and the second slit portion (Q2) is W3 in the axis direction (A2), and the first slit portion (Q1) and the second slit portion (Q2) may be arranged so as not to exceed the area of the concave portion (31) in the axis direction (A2) when viewed in a direction orthogonal to the axis direction (A2).

4. In the development device (3) of the present disclosure, both of the concave portion (31) and the replenishing port (17) may be arranged at a central portion (CT) of the development frame body (30A) in the axis direction (A2).

5. In the development device (3) of the present disclosure, the development frame body (30A) may include: a first replenishing port (17*a*), a first concave portion (31*a*) corresponding to the first replenishing port (17*a*), a second replenishing port (17*b*), and a second concave portion (31*b*) corresponding to the second replenishing port (17*b*).

6. In the development device (3) of the present disclosure, when viewed in the axis direction (A2), the concave portion (31) includes a bottom face (311), a first side face (312) that connects the bottom face (311) and the inner wall face (40A) at an upstream side of the bottom face in the rotation direction, and a second side face (313) that connects the bottom face (311) and the inner wall face (40A) at a downstream side of the bottom face in the rotation direction of the agitation member (8), and the section of the free end (822) of the sheet portion (82) may be arranged to come to abut on the second side face (313) after entering the concave portion (31).

7. In the development device (3) of the present disclosure, a relationship L≤R2 may be satisfied, when a distance from the rotation center (O) to the bottom face (311) of the concave portion (31) is R2.

8. In the development device (3) of the present disclosure, the first side face (312) is arranged at an upstream side of a perpendicular line passing through the rotation center (O), and the second side face (313) may be arranged at a downstream side of the perpendicular line, when viewed in the axis direction (A2).

9. The development device (3) of the present disclosure includes the development frame body (30A) and the agitation member (8), and a developer replenishing device (16) for replenishing the developer containing chamber (4) with developer via the replenishing port (17), can be attached to and detached from the development frame body (30A).

Further, the development frame body (30A) includes a development chamber (5) in which a developer bearing body (6) for bearing developer is housed, a developer containing chamber (4) for storing developer to be supplied to the development chamber (5), and a replenishing port (17) through which the developer containing chamber (4) can be replenished with developer from the outside, the developer containing chamber (4) having a communication port (15) for communicating with the development chamber (5).

The agitation member (8) is housed in the developer containing chamber (4), and includes a rotatable shaft portion and an elastically-deformable sheet portion, one end of the sheet portion is fixed to the shaft portion as a fixed end, and the other end of the sheet portion is a free end (822).

The development frame body (30A) for constructing the developer containing chamber (4) includes a convex portion (41) formed by projecting from the inner wall face (40A) of the development frame body (30A), in a direction (G21) along an downward direction (G2) of the gravitational direction (G) in an in-use orientation, and the convex portion is located at a downstream side of the communication port and an upstream side of the replenishing port (17) in a rotation direction of the agitation member (8).

The convex portion (41) and the replenishing port (17) overlap with each other at least at one part in the axis direction (A2) of the shaft portion, when viewed in a direction orthogonal to the axis direction (A2) of the shaft portion. A relationship R4<R1≤L is satisfied when a free length from the fixed end (821) to the free end (822) of the sheet portion (82) is L, a distance from the rotation center (O) of the shaft portion to the inner wall face (40A) is R1, and a distance from the rotation center (O) of the shaft portion to a leading end (P5) of the convex portion (41) is R4. In the axis direction (A2), The first slit portion (Q1) is formed in the sheet portion (82) at a position corresponding to one end portion of the replenishing port (17), and a second slit portion (Q2) is formed in the sheet portion (82) at a position corresponding to the other end portion of the replenishing port.

10. A cartridge (PC) of the present disclosure includes the development device (3) and the developer replenishing device (16) for replenishing developer to the developer containing chamber (4), which can be attached to and detached from the development frame body (30A).

11. A cartridge of the present disclosure may include an image bearing body (1) which bears a developer image acquired by developing an electrostatic latent image with developer supplied from the developer bearing body (6) and a frame body (14) which supports the image bearing body (1).

12. An image forming apparatus (100) of the present disclosure includes at least any one of the development device (3) and the cartridge (PC), and a transfer member (11).

According to the present disclosure, a developer containing chamber (4) can be replenished with developer, backflow of developer from the developer containing chamber (4) to a replenishing port (17) can be reduced, and replenishing efficiency can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-153054, filed Aug. 23, 2019, which is hereby incorporated by reference herein in its entirety.

What is claimed is:

1. A development device comprising:

a development frame body including a development chamber in which a developer bearing body for bearing developer is housed, a developer containing chamber for storing developer to be supplied to the development chamber, and a replenishing port through which the developer containing chamber can be replenished with developer from outside, the developer containing chamber having a communication port for communicating with the development chamber; and an agitation member housed in the developer containing chamber and including a rotatable shaft portion and an elastically-deformable sheet portion, one end of the sheet portion being fixed to the shaft portion as a fixed end, and the other end of the sheet portion being a free end, wherein a developer replenishing device, for replenishing developer to the developer containing chamber via the replenishing port, can be attached to and detached from the development frame body, wherein the development frame body for constructing the developer containing chamber includes a concave portion formed by projecting from an inner wall face of the development frame body, in a direction along an upward direction of a gravitational direction in an in-use orientation, the concave portion being located at a downstream side of the communication port and an upstream side of the replenishing port in a rotation direction of the agitation member, wherein the concave portion and the replenishing port overlap with each other at least at one part in an axis direction of the shaft portion, when viewed in a direction orthogonal to the axis direction of the shaft portion, wherein a relationship R1≤L is satisfied, when a free length from the fixed end to the free end of the sheet portion is L and a distance from a rotation center of the shaft portion to the inner wall face is R1, and wherein slit portions are formed in the free end of the sheet portion, so that a section of the free end of the sheet portion is able to enter the concave portion when the agitation member is rotated.

2. The development device according to claim 1, wherein a relationship W1≤W2 is satisfied, when a width of the replenishing port is W1 and a width of the concave portion is W2 in the axis direction, and wherein an area of the replenishing port does not exceed an area of the concave portion in the axis direction when viewed in a direction orthogonal to the axis direction.

3. The development device according to claim 2, wherein a first slit portion and a second slit portion are formed in the sheet portion, wherein a relationship W1≤W3≤W2 is satisfied, when a distance between the first slit portion and the second slit portion is W3 in the axis direction, and wherein the first slit portion and the second slit portion are arranged so as not to exceed the area of the concave portion in the axis direction when viewed in a direction orthogonal to the axis direction.

4. The development device according to claim 1, wherein both of the concave portion and the replenishing port are arranged at a central portion of the development frame body in the axis direction.

5. The development device according to claim 1, wherein the development frame body includes:

a first replenishing port;

a first concave portion corresponding to the first replenishing port;

a second replenishing port; and a second concave portion corresponding to the second replenishing port.

6. The development device according to claim 1, wherein, when viewed in the axis direction, the concave portion includes a bottom face, a first side face that connects the bottom face and the inner wall face at an upstream side of the bottom face in the rotation direction, and a second side face that connects the bottom face and the inner wall face at a downstream side of the bottom face in the rotation direction of the agitation member, and wherein the section of the free end of the sheet portion comes to abut on the second side face after entering the concave portion.

7. The development device according to claim 6, wherein a relationship L≤R2 is satisfied, when a distance from the rotation center to the bottom face of the concave portion is R2.

8. The development device according to claim 6, wherein, the first side face is arranged at an upstream side of a perpendicular line passing through the rotation center, and the second side face is arranged at a downstream side of the perpendicular line, when viewed in the axis direction.

9. A cartridge comprising:

the development device according to claim 1; and a developer replenishing device, for replenishing developer to the developer containing chamber, which can be attached to and detached from the development frame body.

10. The cartridge according to claim 9, further comprising:

an image bearing body that bears a developer image acquired by developing an electrostatic latent image with developer supplied from the developer bearing body; and a frame body that supports the image bearing body.

11. An image forming apparatus comprising:

the development device according to claim 1; and a transfer member.

12. An image forming apparatus comprising:

the cartridge according to claim 9; and a transfer member.

13. A development device comprising:

a development frame body including a development chamber in which a developer bearing body for bearing developer is housed, a developer containing chamber for storing developer to be supplied to the development chamber, and a replenishing port through which the developer containing chamber can be replenished with developer from outside, the developer containing chamber having a communication port for communicating with the development chamber; and an agitation member housed in the developer containing chamber and including a rotatable shaft portion and an elastically-deformable sheet portion, one end of the sheet portion being fixed to the shaft portion as a fixed end, and the other end of the sheet portion being a free end, wherein a developer replenishing device, for replenishing developer to the developer containing chamber via the replenishing port, can be attached to and detached from the development frame body, wherein the development frame body for constructing the developer containing chamber includes a convex portion formed by projecting from an inner wall face of the development frame body, in a direction along a downward direction of a gravitational direction in an in-use orientation, the convex portion being located at a downstream side of the communication port and an upstream side of the replenishing port in a rotation direction of the agitation member, wherein the convex portion and the replenishing port overlap with each other at least at one part in an axis direction of the shaft portion, when viewed in a direction orthogonal to the axis direction of the shaft portion, wherein a relationship $R4<R1\leq L$ is satisfied, when a free length from the fixed end to the free end of the sheet portion is L, a distance from a rotation center of the shaft portion to the inner wall face is R1, and a distance from the rotation center of the shaft portion to a leading end of the convex portion is R4, and wherein, in the axis direction, a first slit portion is formed in the sheet portion at a position corresponding to one end portion of the replenishing port, and a second slit portion is formed in the sheet portion at a position corresponding to the other end portion of the replenishing port.

14. A cartridge comprising:

the development device according to claim 13; and a developer replenishing device, for replenishing developer to the developer containing chamber, which can be attached to and detached from the development frame body.

15. An image forming apparatus comprising:

the development device according to claim 13 or the cartridge according to claim 13; and a transfer member.

* * * * *